US007240792B2

(12) United States Patent
Schneider et al.

(10) Patent No.: US 7,240,792 B2
(45) Date of Patent: Jul. 10, 2007

(54) PACKAGING FOR A SINK

(75) Inventors: Wolfgang Schneider, Eppingen (DE); Dirk Bittger, Karlsruhe (DE)

(73) Assignee: Blanco GmbH + Co KG, Oberderdingen (DE)

( * ) Notice: Subject to any disclaimer, the term of this patent is extended or adjusted under 35 U.S.C. 154(b) by 484 days.

(21) Appl. No.: 10/872,855

(22) Filed: Jun. 21, 2004

(65) Prior Publication Data

US 2005/0263427 A1 Dec. 1, 2005

(30) Foreign Application Priority Data

May 29, 2004 (EP) ..... 04012865
May 29, 2004 (EP) ..... 04012866

(51) Int. Cl.
*B65D 85/30* (2006.01)

(52) U.S. Cl. ..... 206/523; 206/321; 206/592

(58) Field of Classification Search ..... 206/321, 206/521, 523, 588, 589, 590, 592
See application file for complete search history.

(56) References Cited

U.S. PATENT DOCUMENTS

| | | | | |
|---|---|---|---|---|
| 3,845,859 | A * | 11/1974 | Dornbush | 206/320 |
| 4,039,077 | A * | 8/1977 | Sorenson | 206/320 |
| 4,386,702 | A * | 6/1983 | Schultz et al. | 206/523 |
| 4,584,822 | A | 4/1986 | Fielding et al. | 53/452 |
| 4,828,115 | A * | 5/1989 | Wiegand et al. | 206/576 |
| 5,522,502 | A * | 6/1996 | Orr et al. | 206/320 |
| 5,642,813 | A * | 7/1997 | Nyseth | 206/597 |
| 5,653,550 | A | 8/1997 | Mutz et al. | |
| 5,860,172 | A | 1/1999 | Pfeiffer | |
| RE37,253 | E | 7/2001 | Moren et al. | 206/586 |
| 6,308,351 | B1 | 10/2001 | Franke | |
| 6,382,422 | B1 * | 5/2002 | Bocek | 206/586 |
| 6,877,608 | B2 * | 4/2005 | Koike | 206/592 |
| D508,555 | S | 8/2005 | Ziemann | |
| D518,881 | S | 4/2006 | Ziemann | |
| 2002/0033352 | A1 * | 3/2002 | Levin et al. | 206/589 |
| 2003/0041374 | A1 | 3/2003 | Franke | |
| 2004/0078892 | A1 | 4/2004 | Albarran | |

(Continued)

FOREIGN PATENT DOCUMENTS

DE 19 20 893 A 11/1970

(Continued)

OTHER PUBLICATIONS

European Patent Office Search Report for European Patent Application No. 04 012 865.4, Nov. 3, 2004 (3 pages).

(Continued)

*Primary Examiner*—David T. Fidei
(74) *Attorney, Agent, or Firm*—Hanley, Flight & Zimmerman

(57) ABSTRACT

In order to produce a packaging for a sink which has particularly good absorption properties and a low rate of transportation damage there is proposed a packaging for a sink which comprises at least one supporting body that is formed at least partly from a foamed plastic material and comprises at least one seating element incorporating a seating channel for an edge section of the sink, and an outer packaging whose interior accommodates the sink and the at least one supporting body, wherein the at least one supporting body extends over substantially the entire internal height of the interior of the outer packaging.

48 Claims, 25 Drawing Sheets

U.S. PATENT DOCUMENTS

2005/0205193 A1 9/2005 Von Mertz

FOREIGN PATENT DOCUMENTS

| | | | |
|---|---|---|---|
| DE | 1628684 | | 12/1970 |
| DE | 2640935 | A1 | 3/1977 |
| DE | 2813088 | A | 10/1979 |
| DE | 7820319 | U1 | 12/1979 |
| DE | 3 110 134 | | 10/1982 |
| DE | 3925590 | A | 2/1991 |
| DE | 4241023 | A | 6/1994 |
| DE | 29620839 | U1 | 3/1997 |
| DE | 29822399 | U1 | 4/1999 |
| DE | 4437630 | C1 | 10/2006 |
| EP | 0685021 | B1 | 12/1995 |
| EP | 0 709 528 | | 5/1996 |
| EP | 0 976 881 | | 2/2000 |
| EP | 1 103 665 | | 5/2001 |
| EP | 1 188 685 | A2 | 3/2002 |
| FR | 1319427 | | 3/1963 |
| FR | 2430532 | | 7/1979 |
| FR | 2 832 440 | | 5/2003 |
| GB | 2108195 | A | 5/1983 |
| GB | 2263060 | A | 7/2006 |
| JP | 63272682 | | 11/1988 |
| JP | 10029684 | | 2/1998 |
| NL | 8201555 | | 11/1983 |

OTHER PUBLICATIONS

European Patent Office Search Report for European Patent Application No. 04 012 866.2, Nov. 12, 2004 (3 pages).

International Search Report corresponding to International Application Serial No. PCT/EP2004/007830, Oct. 5, 2004, 3 pages.

Ziemann, Brigitte, U.S. Appl. No. 29/225,634, filed Mar. 18, 2005 for "Sink." Abandoned.

Schneider, Wolfgang et al., U.S. Appl. No. 11/140,830, filed May 31, 2005 for "Built-Under Sinks."

Schneider, Wolfgang et al., U.S. Appl. No. 29/240,298, filed Oct. 11, 2005 for "Sink."

Ziemann, Brigitte, U.S. Appl. No. 29/242,626, filed Nov. 10, 2005 for "Sink Performa K3 30 Single Bar."

Ziemann, Brigitte, U.S. Appl. No. 29/242,523, filed Nov. 10, 2005 for "Sink Performa K3 30 Double."

Ziemann, Brigitte, U.S. Appl. No. 29/242,581, filed Nov. 10, 2005 for "Sink Performa K3 30 1.5."

Ziemann, Brigitte, U.S. Appl. No. 29/242,618, filed Nov. 10, 2005 for "Sink Performa K4 2.0 Small."

Ziemann, Brigitte, U.S. Appl. No. 29/242,607, filed Nov. 10, 2005 for "Sink Performa K4 1.0 Large."

Ziemann, Brigitte, U.S. Appl. No. 29/242,608, filed Nov. 10, 2005, for "Sink Performa K4 1.0 Super Single."

Ziemann, Brigitte, U.S. Appl. No. 29/242,611, filed Nov. 10, 2005 for "Sink Performa K4 1.5."

Ziemann, Brigitte, U.S. Appl. No. 29/242,627, filed Nov. 10, 2005 for "Sink Performa K4 1.75."

Ziemann, Brigitte, U.S. Appl. No. 29/242,600, filed Nov. 10, 2005 for "Sink Performa V2 33 1.75 Left."

Ziemann, Brigitte, U.S. Appl. No. 29/242,599, filed Nov. 10, 2005 for "Sink Performa V2 Big Single."

Ziemann, Brigitte, U.S. Appl. No. 29/242,610, filed Nov. 10, 2005 for "Sink Performa V2 Double."

Ziemann, Brigitte, U.S. Appl. No. 29/242,612, filed Nov. 10, 2005 for "Sink Performa V2 Single Bar."

Von Mertz et al., U. S. Appl. No. 11/321,683, filed Dec. 28, 2005, for "A Movement Mechanism Moving a Closure Element for the Purposes of Sealing a Waste Outlet Opening."

Schneider, Wolfgang et al., U.S. Appl. No. 11/403,315, filed Apr. 13, 2006 for "Sink."

Schneider, Wolfgang et al., U.S. Appl. No. 29/256,748, filed Mar. 24, 2006, for "Sink."

Von Mertz, Gert Spruner, U.S. Appl. No. 11/057,961, filed Aug. 13, 2003, for "Installation Elements and Methods for Fastening an Installation Element to a Work Surface."

International Search Report corresponding to International Application No. PCT/EP2004/012840 (5 pages).

Office action of German Patent Office corresponding to German Application No. 103 55 032.1 (2 pages).

* cited by examiner

PACKAGING FOR A SINK

RELATED APPLICATIONS

The present disclosure is concerned with the articles which have been disclosed in the European patent applications No. 04 012 866.2 dated 29 May 2004 and No. 04 012 865.4 dated 29 May 2004. The entire descriptions of these earlier applications are incorporated by reference into the present description.

FIELD OF THE DISCLOSURE

The present invention relates to a packaging for a sink.

BACKGROUND

It is known to pack sinks individually into a respective transportation carton and to use shaped members made from a foamed plastic material so as to protect the sink from the effects of shock loadings.

In particular, a packaging for a sink is known wherein two seating strips of foamed material are pushed onto the short side walls of the edge of a sink which comprises two equally large basins. Furthermore, in the case of this sink packaging, a web protector having a U-shaped cross section is placed on the intermediate web located between the two basins from above, and the two basins are supported from below by a substantially T-shaped supporting body which is arranged below the bases of the basins and below the intermediate web separating the two basins from one another. This known sink packaging thus comprises four shaped members made of foamed plastic material which are arranged on the sink separately from one another and are not in contact with one another. The shaped members and the sink are accommodated in a cuboid outer packaging, wherein each of the shaped members is of significantly lesser height than the interior of the outer packaging so that each of the shaped members can be supported either only on the base or only on the top wall of the outer packaging.

SUMMARY

The object of the present invention is to produce a packaging for a sink which has particularly good absorption properties and a low rate of transportation damage.

This object is achieved in accordance with a first embodiment of the invention by a packaging for a sink which comprises at least one supporting body that is formed at least partly from a foamed plastic material and comprises at least one seating element incorporating a seating channel for an edge section of the sink, and an outer packaging whose interior accommodates the sink and the at least one supporting body, wherein the at least one supporting body extends over substantially the entire internal height of the interior of the outer packaging.

Due to the fact that in the sink packaging in accordance with the invention the at least one supporting body extends over substantially the entire internal height of the interior of the outer packaging, this supporting body can be supported both on the base and on the top wall of the outer packaging, whereby the vertical displacement path of the supporting body within the outer packaging is reduced whilst the sink is prevented from striking the outer packaging in the vertical direction when the packaging is being transported.

In the context of this description and the accompanying Claims, a supporting body which extends over substantially the entire internal height of the interior of the outer packaging, is to be understood as meaning a supporting body whose height (vertical extent) amounts to at least 90% of the internal height H of the interior of the outer packaging.

It is particularly expedient, if the height of the supporting body amounts to at least 95% of the entire internal height of the interior of the outer packaging.

Because the supporting body is formed at least partly from a foamed plastic material, a far better absorption effect is obtained than is the case when using packaging elements made of corrugated cardboard for example.

Preferably, the supporting body is formed substantially entirely from a foamed plastic material, in particular from expanded polystyrene.

Due to the good absorption properties and the low rate of transportation damage resulting therefrom, the sink packaging in accordance with the invention is especially suitable for the packaging of particularly fragile sinks, for example those made of ceramic and/or composite materials.

The sink packaging in accordance with the invention enables sinks to be packaged in a particularly economical and procedurally reliable manner.

In principle, the at least one supporting body of the sink packaging in accordance with the invention may be in one-piece form, i.e. comprise just the seating element.

However, in a preferred embodiment of the sink-packaging in accordance with the invention, provision is made for the at least one supporting body to comprise at least one distance maintaining element which is formed separately from the seating element and which supports said seating element.

Due to the fact that in this case the seating element accommodating the edge section of the sink is directly in contact with the distance maintaining element supporting the seating element, a particularly high absorption effect is obtained with regard to impacts effective externally upon the sink packaging. Since, in this case, the supporting body of the sink packaging in accordance with the invention comprises two separate elements which are in contact with one another in at least one contact area, the effect is achieved that shock loadings cannot spread unimpaired through the entire supporting body as is the case for a one-piece supporting body, but rather, an additional absorption of the impacts takes place due to the transition from the one element to the other element of the supporting body at the contact area.

At the same time however, the absorption capacity of the supporting body is increased due to the additional volume of the distance maintaining element as opposed to the case of a supporting body which were to comprise just the seating element.

The distance maintaining element can be seated, in particular, on the base of the outer packaging of the sink packaging.

The seating element and/or the distance maintaining element can be formed at least partly, but preferably completely, from a foamed plastic material.

Particularly high stability of the packaging and a good absorption effect thereof are obtained, if provision is advantageously made for the seating channel of the seating element to be formed for accommodating an edge section of a long side of the sink.

It has proved to be particularly expedient, if the seating channel of the seating element is formed for accommodating an edge section of the sink which extends over the entire length of a side of the sink, preferably a long side of the sink.

The edge section of the sink is protected particularly well by the sink packaging, if the seating channel of the seating element is formed for accommodating an edge section of the sink which extends along a first side of the sink, and for accommodating an edge section of the sink which extends along a second side of the sink.

Furthermore, it is particularly expedient if the seating channel of the seating element is formed for accommodating an edge section of the sink which extends along a third side of the sink.

Since the corner areas of the sink are particularly highly exposed to impacts during transportation, it is of advantage, if the seating channel of the seating element is formed for accommodating at least one corner area of the edge of the sink.

In order to keep the number of different elements needed for the packaging of the sink as small as possible, it is of advantage, if the distance maintaining element of the supporting body has the same shape as the seating element of the supporting body.

In a preferred embodiment of the invention, provision is made for the packaging to comprise at least two supporting bodies which respectively comprise at least one seating element incorporating a seating channel for an edge section of the sink and at least one distance maintaining element which is formed separately from the seating element and which supports the respectively associated seating element.

In this case, it is of advantage for the purposes of reducing the number of different elements needed for the packaging, if the seating elements and the distance maintaining elements of the at least two supporting bodies are of the same shape.

In a particularly preferred embodiment of the sink packaging, the latter comprises two supporting bodies which comprise in toto two seating elements and two distance maintaining elements, wherein all four of these elements are of the same shape so that each of these elements can be interchanged within the packaging and only one tool is required for the production of all of these elements.

Preferably, the at least two supporting bodies of the packaging are arranged at mutually opposite edge sections of the sink.

It has proved to be particularly expedient for the absorption behaviour of the packaging, if the entire weight of the sink is borne exclusively by the supporting bodies which respectively comprise a seating element incorporating a seating channel for an edge section of the sink. This embodiment of the invention has the further advantage that no further component of the sink packaging is compellingly necessary, which thus reduces the number of elements needed for the packaging of the sink.

Preferably, the at least one basin of the sink is not seated on an element of the packaging.

The outer packaging of the sink packaging may, in particular, be substantially cuboid.

Furthermore, provision may be made for the outer packaging to comprise a folding carton.

The seating element of the sink packaging in accordance with the invention may, in particular, be in the form of a seating strip.

If the seating element is of substantially L-shaped form, then only the position of a corner area of the edge of the sink is fixed relative to the seating element, whilst the free ends of the legs of the L-shaped seating element can, in principle, be spaced from the other corner areas of the edge of the sink by arbitrary distances. Such a seating element can therefore be used for the packaging of arbitrarily wide and arbitrarily long sinks.

As an alternative thereto, provision may also be made for the seating element to be of substantially U-shaped form. In this embodiment, the position of the seating element is fixed with respect to two corner areas of the edge of the sink. In principle however, the distance of the free ends of the U-shaped seating element from the other two corner areas of the edge of the sink is arbitrary so that such a U-shaped seating element can be used for the packaging of sinks having a length falling within a given tolerance interval, although they may be of different widths. Thereby, the tolerance interval is determined by the depth of the seating channel in the end regions of the U-shaped seating element, i.e. by the extent thereof in the transverse direction of the seating element, and this enables sinks having lengths varying within the tolerance interval to be packaged by means of the same seating elements, the central regions of these seating elements being pushed onto the long sides of the sinks.

Furthermore, such a U-shaped seating element can be used for the packaging of sinks having a width falling within a given tolerance interval, although they may be of different lengths. Thereby, the tolerance interval is determined by the depth of the seating channel in the end regions of the U-shaped seating element, i.e. by the extent thereof in the transverse direction of the seating element, and this enables sinks having widths varying within the tolerance interval to be packaged by means of the same seating elements, the central regions of these seating elements being pushed onto the short sides of the sinks.

In a preferred embodiment of the invention, provision is made for the seating element to comprise a longitudinal section which extends in the longitudinal direction of the sink.

Furthermore, provision may be made for the seating element to comprise at least one transverse section, which extends in the transverse direction of the sink.

Preferably hereby, the transverse section ends at a distance from the longitudinal central plane of the sink, this thereby preventing the free ends of the seating elements of mutually opposed supporting bodies from coming into contact with one another.

Particularly good absorption properties for the seating element are obtained, if the seating channel of the seating element is limited upwardly and/or downwardly by a plurality of channel delimiting projections which are spaced from one another in the longitudinal direction of the seating channel so that the sink only comes into contact with the seating element at the channel delimiting projections, but not in the regions located between the channel delimiting projections.

Furthermore, provision is preferably made for the seating element to comprise at least one end section which is provided with at least one cavity.

Hereby, particularly high resilient deformability and thus a particularly good absorption effect for the end section of the seating element is obtained if the cavity has a vertical cross section which comprises a constriction.

An end section of the seating element having a good absorption effect and nevertheless high stability is obtained, if the cavity formed in the end section widens towards an end face of the end section.

In this case, the cavity has a vertical cross section which varies in the longitudinal direction of the end section.

Hereby, the variation in the vertical cross section can be effected continuously, or else in one or more discrete steps.

It has proved to be particularly expedient if the cavity merges into the end face of the end section.

Furthermore it has proved expedient if the end section provided with the cavity is provided with a recess (for example the seating channel) at the side thereof facing the sink, whereby the deformability of the end section is increased when it is effected by a shock loading.

The upper surface of the seating element can be provided with projections which come to rest on a top wall of the outer packaging of the sink packaging so that impacts will not be transferred from the outer packaging to the seating element over the entire upper surface of the seating element, but rather, will only be transferred to the seating element via the projections that are spaced from one another in the longitudinal direction of the seating element.

Provision may likewise be made for the supporting body to comprise a distance maintaining element which is formed separately from the seating element and is provided on the lower surface thereof with projections which come to rest on a bottom wall of the outer packaging of the sink packaging so that impacts cannot be transferred from the bottom wall of the outer packaging to the distance maintaining element over the entire lower surface of the distance maintaining element, but rather, will only be transferred to the distance maintaining element via the projections which are spaced from one another in the longitudinal direction of the distance maintaining element.

In a preferred embodiment of the invention, the lower surface of the seating element is provided with projections and/or with recesses and the upper surface of the distance maintaining element is provided with projections and/or with recesses, the projections and/or the recesses on the lower surface of the seating element cooperating with the projections and/or the recesses on the upper surface of the distance maintaining element in such a way that the seating element seated on the distance maintaining element is fixed relative to the distance maintaining element in the longitudinal direction of said seating element and/or in a horizontal transverse direction extending transversely relative to the longitudinal direction thereof. This arrangement contributes to increased stability of the supporting body which is formed from the seating element and the distance maintaining element because, in this case, the seating element and the distance maintaining element can only be released from one another by virtue of a vertically extending relative movement.

In a preferred embodiment of the packaging in accordance with the invention, the latter comprises a cover element which covers at least a part of the sink in the upward direction.

In particular, provision may be made for the cover element to cover at least one basin of the sink in the upward direction. It is in this manner that accessories accommodated in this basin of the sink are prevented from shifting or slipping out.

Preferably, the cover element does not extend over the entire upper surface of the sink.

It has proved expedient, if the cover element engages with the seating element in such a way that it is safeguarded from displacement relative to the seating element in the longitudinal direction thereof.

Furthermore, provision may be made, in particular, for the cover element to engage with the seating element in such a way that the displacement path thereof relative to the seating element is limited in the vertical direction, preferably to at most approximately 3 cm.

The cover element may comprise a substantially horizontal cover section and a retaining section which is aligned transversely relative to the cover section, preferably substantially perpendicularly thereto.

Furthermore, the packaging in accordance with the invention may comprise at least one accessory box, for example a cutting board box, whereby it is expedient if the seating element comprises at least one stop member which limits the displacement path of the accessory box relative to the seating element in the longitudinal direction of the seating element. Slippage of the accessory box in the longitudinal direction of the seating element is thereby prevented during transportation.

If the packaging comprises two supporting bodies having at least one seating element and if furthermore, it comprises an accessory box, then the horizontal spacing of the seating elements from one another preferably corresponds substantially to the width of the accessory box so that the accessory box is accommodated between the seating elements with only a small amount of play and is safeguarded from slippage in the transverse direction of the seating elements.

In a preferred embodiment of the invention, the packaging comprises at least two supporting bodies each having a respective seating element and furthermore, an intermediate element arranged between the two supporting bodies.

The intermediate element is preferably in engagement with the supporting bodies in such a way that it is safeguarded from movement relative to the supporting bodies in the longitudinal direction thereof.

Furthermore it is expedient, if the intermediate element engages with the supporting bodies in such a way that it is safeguarded from vertical movement relative to the supporting bodies.

This intermediate element may comprise at least one projection which engages in a gap between the seating element and the distance maintaining element of one of the supporting bodies.

The intermediate element may have a substantially angular shape and comprise, in particular, a substantially horizontal first section and a second section which is aligned transversely, preferably substantially perpendicularly, relative to the horizontal first section.

Furthermore, provision may be made for the packaging to comprise an accessory unit which is arranged below the sink, wherein the intermediate element is formed and arranged in such a manner that it separates the accessory unit, for example a mixer tap box, from the sink.

It is in this way that the accessory unit is prevented from coming into contact with the sink during transportation, whereby both the accessory unit and the sink could be damaged.

In order to save weight and to improve the absorption properties of the intermediate element, provision may be made for the intermediate element to be provided with at least one recess on the side thereof remote from the sink.

Preferably, the intermediate element is made from substantially the same material as the seating elements of the supporting bodies.

The seating element and/or the distance maintaining element can, in particular, be formed at least partly from an expanded polystyrene material.

The seating element can be arranged in the same way on each side of the sink, if provision is advantageously made for the seating element to be formed substantially symmetrically relative to the vertical transverse central plane thereof.

Furthermore, in a preferred embodiment of the invention, provision is made for the seating element to be stackable directly on another seating element of the same shape and orientation.

Apart from being used for packaging a sink individually, the seating element can also be used for packaging a plurality of sinks arranged in a stack if the seating element having an edge section of a sink accommodated in the seating channel thereof is stackable directly on another seating element of the same shape and orientation and in whose seating channel an edge section of a sink of the same shape and orientation is likewise accommodated.

If the seating element is stackable directly on another seating element of the same shape and orientation, then it is preferable for the lower surface of the seating element to be provided with projections and/or with recesses, for the upper surface of the other identically formed seating element to be provided with projections and/or with recesses, and for the projections and/or the recesses on the lower surface of the one seating element to cooperate with the projections and/or the recesses on the upper surface of the other seating element in such a way that the seating element seated on the other seating element is fixed relative to the other seating element in the longitudinal direction thereof and/or in a horizontal transverse direction thereof extending transversely to said longitudinal direction. This arrangement contributes to increased stability of the pile which is formed from the two seating elements or from yet further seating elements since, in this case, the seating elements can only be released from one another by means of a vertically extending relative movement.

The object of the invention is achieved in accordance with a second embodiment of the invention by a packaging for a sink that comprises at least one supporting body which, for its part, comprises at least one seating element incorporating a seating channel for an edge section of the sink and at least one distance maintaining element which is formed separately from the seating element and which supports the seating element, wherein the seating element and/or the distance maintaining element are formed at least partly from a foamed plastic material.

Due to the fact that in the sink packaging in accordance with the invention, the seating element accommodating the edge section of the sink is in direct contact with the distance maintaining element supporting the seating element, a particularly high absorption effect in regard to impacts effective on the sink packaging from the exterior is obtained. Since the supporting body of the sink packaging in accordance with the invention is not formed in one-piece but comprises two separate elements which are in contact with one another at least one contact area, the effect is achieved that shock loadings cannot spread unimpaired through the entire supporting body as is the case with a one-piece supporting body, but rather, there is an additional absorption of the impacts due to the transition from the one element to the other element of the supporting body at the contact area.

At the same time however, the absorption capacity of the supporting body is increased due to the additional volume of the distance maintaining element as opposed to the case of a supporting body which were to comprise just the seating element.

The distance maintaining element can be seated, in particular, on the base of an outer packaging of the sink packaging.

Because the seating element and/or the distance maintaining element of the supporting body are formed at least partly, but preferably completely, from a foamed plastic material, a far better absorption effect is obtained than when using packaging elements made from corrugated cardboard for example.

Due to the good absorption properties and the very low rate of transportation damage resulting therefrom, the sink packaging in accordance with the invention is suitable, in particular, for the packaging of particularly fragile sinks such as those made of ceramic and/or composite materials for example.

The sink packaging in accordance with the invention enables sinks to be packaged in a particularly economical and procedurally reliable manner.

Further features and advantages of the invention form the subject mater of the following description and the diagrammatic illustration of an exemplary embodiment.

BRIEF DESCRIPTION OF THE DRAWINGS

In the drawings.

Similar or functionally equivalent elements are referenced by the same reference symbols in each of the Figures.

DETAILED DESCRIPTION

Figure 1:
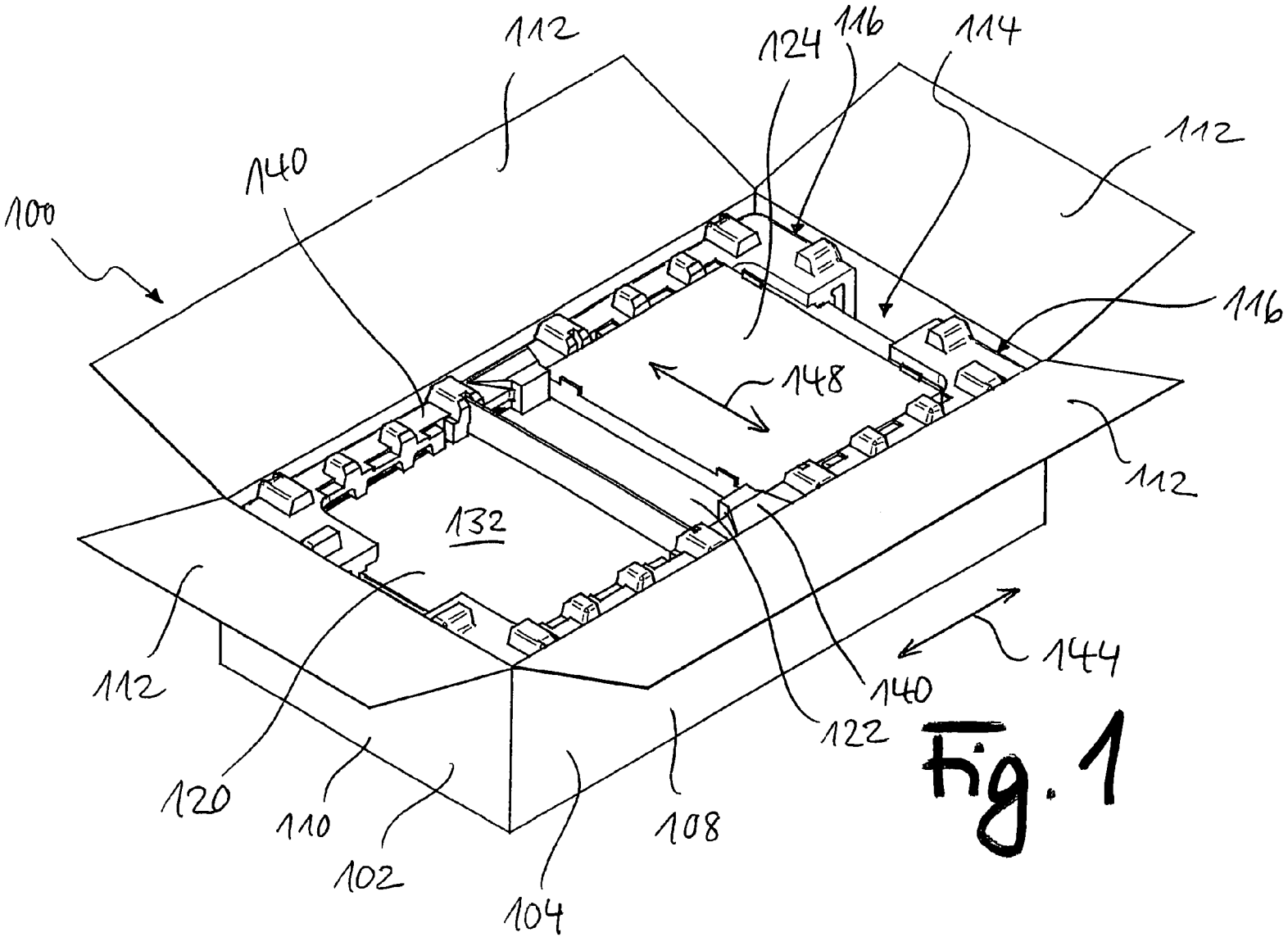
FIG. 1 shows a schematic perspective illustration of a sink packaging which comprises an outer packaging in the form of a folding carton, two supporting bodies each formed by a respective seating element and a distance maintaining element, an intermediate element which connects the two supporting bodies together, a basin cover for the sink and a cutting board box which is arranged on the cover.

A sink packaging bearing the general reference 100 and illustrated in FIGS. 1 to 24 comprises an outer packaging 102 in the form of a substantially cuboid folding carton 104 which comprises a base 106, two long side walls 108, two short side walls 110 as well as the folding flaps 112 which are arranged at the top edges of the side walls 108, 110 and which together form a top wall of the outer packaging 102 when they are in the folded state.

Figure 3:
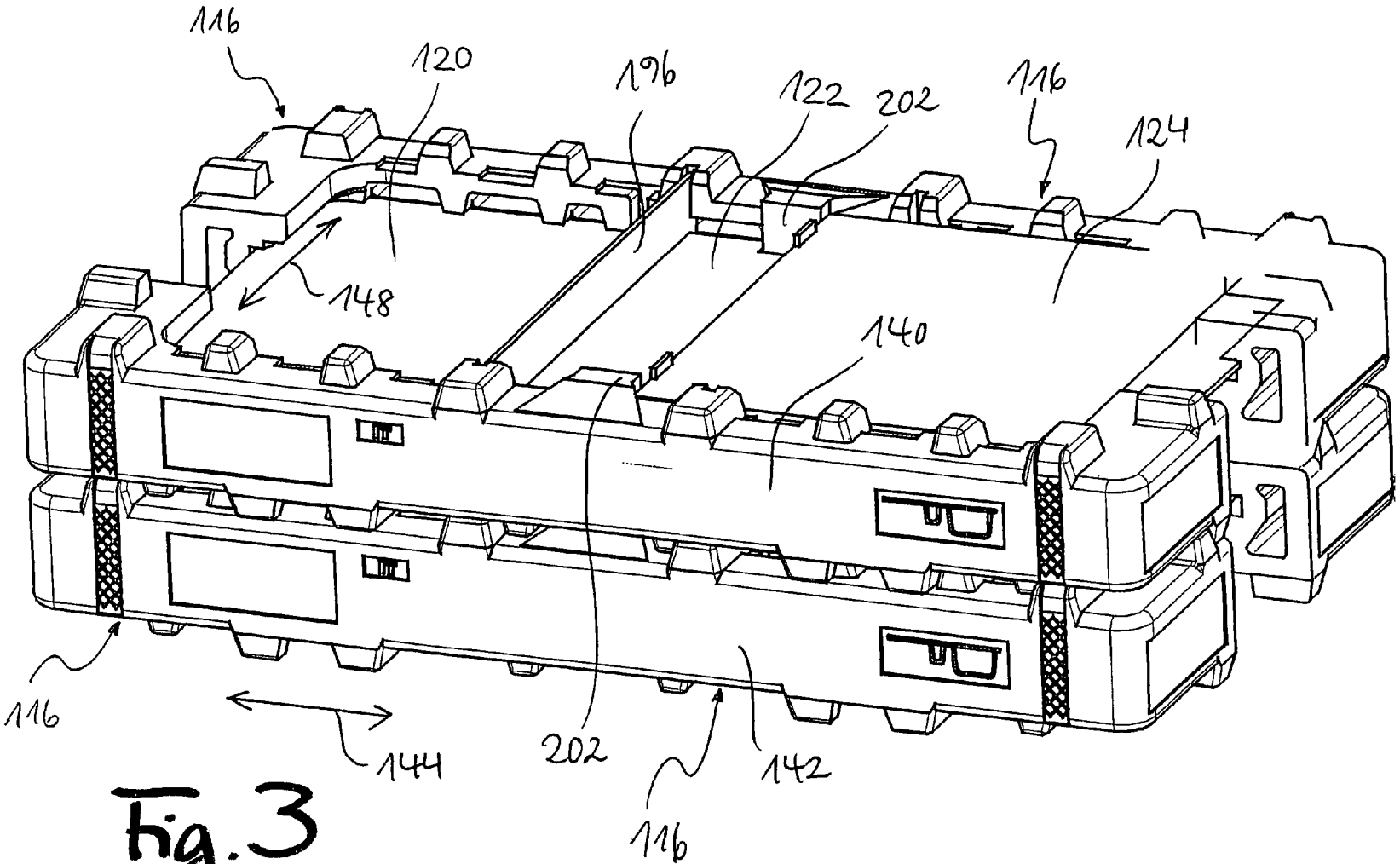
FIG. 3 a schematic perspective illustration of the sink packaging depicted in FIG. 1 without the outer packaging, from above right.
Figure 4:
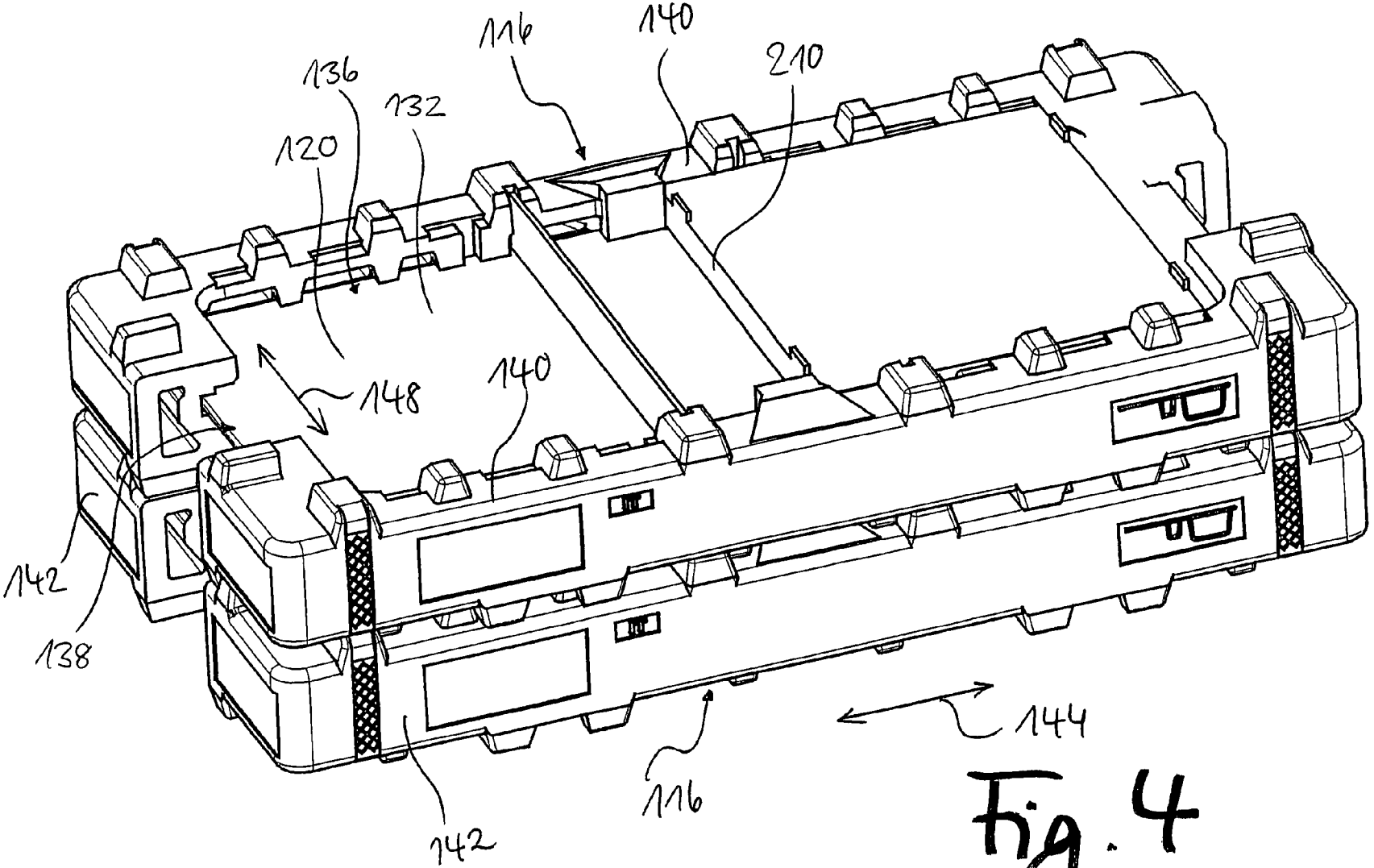
FIG. 4 a further schematic perspective illustration of the sink packaging without the outer packaging, from above left.
Figure 5:
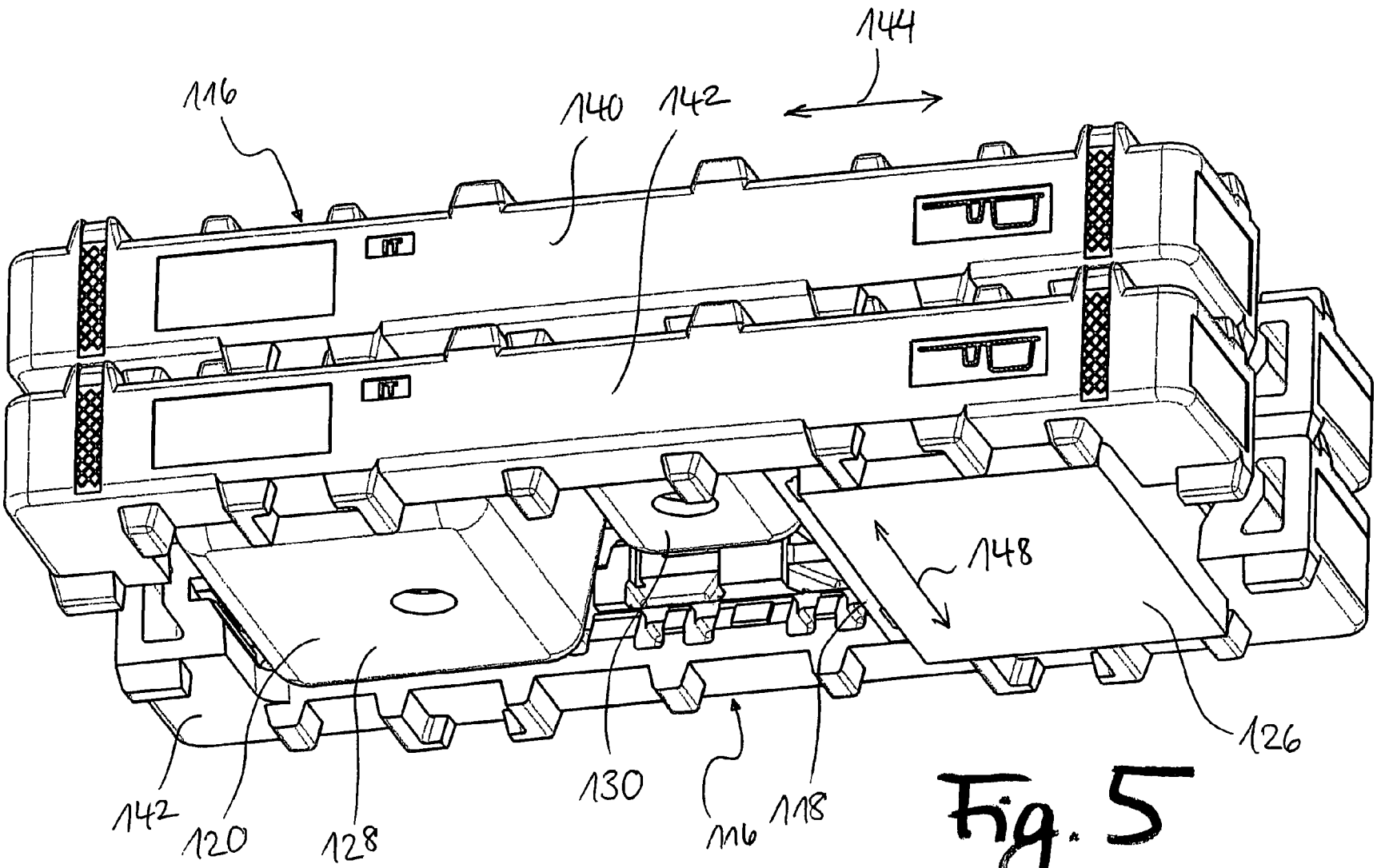
FIG. 5 a schematic perspective illustration of the sink packaging without the outer packaging from below.

The arrangement illustrated perspectively from different view points in FIGS. 3 to 5 is accommodated in the interior 114 of the outer packaging 102 and it comprises two mutually opposite supporting bodies 116, an intermediate element 118 (see FIG. 8) which connects the supporting bodies 116 to one another, a sink 120 which is arranged between the supporting bodies 116, a basin cover 122 which covers a part of the upper surface of the sink in the upward direction, a cutting board box 124 resting on the basin cover 122 and a mixer tap box 126 (see FIG. 5) which is accommodated between the supporting bodies 116 and the intermediate element 118 on the side of the intermediate element 118 remote from the sink 120.

Here, the height of each supporting body 116 substantially corresponds to the internal height H of the interior 114 of the outer packaging 102 in order to prevent a vertical movement of the supporting bodies 116 within the outer packaging.

Furthermore, the length of each supporting body 116 substantially corresponds to the internal length L of the interior 114 of the outer packaging 102 in order to prevent slippage of the supporting bodies 116 within the outer packaging 102 in the longitudinal direction thereof.

Figure 2:
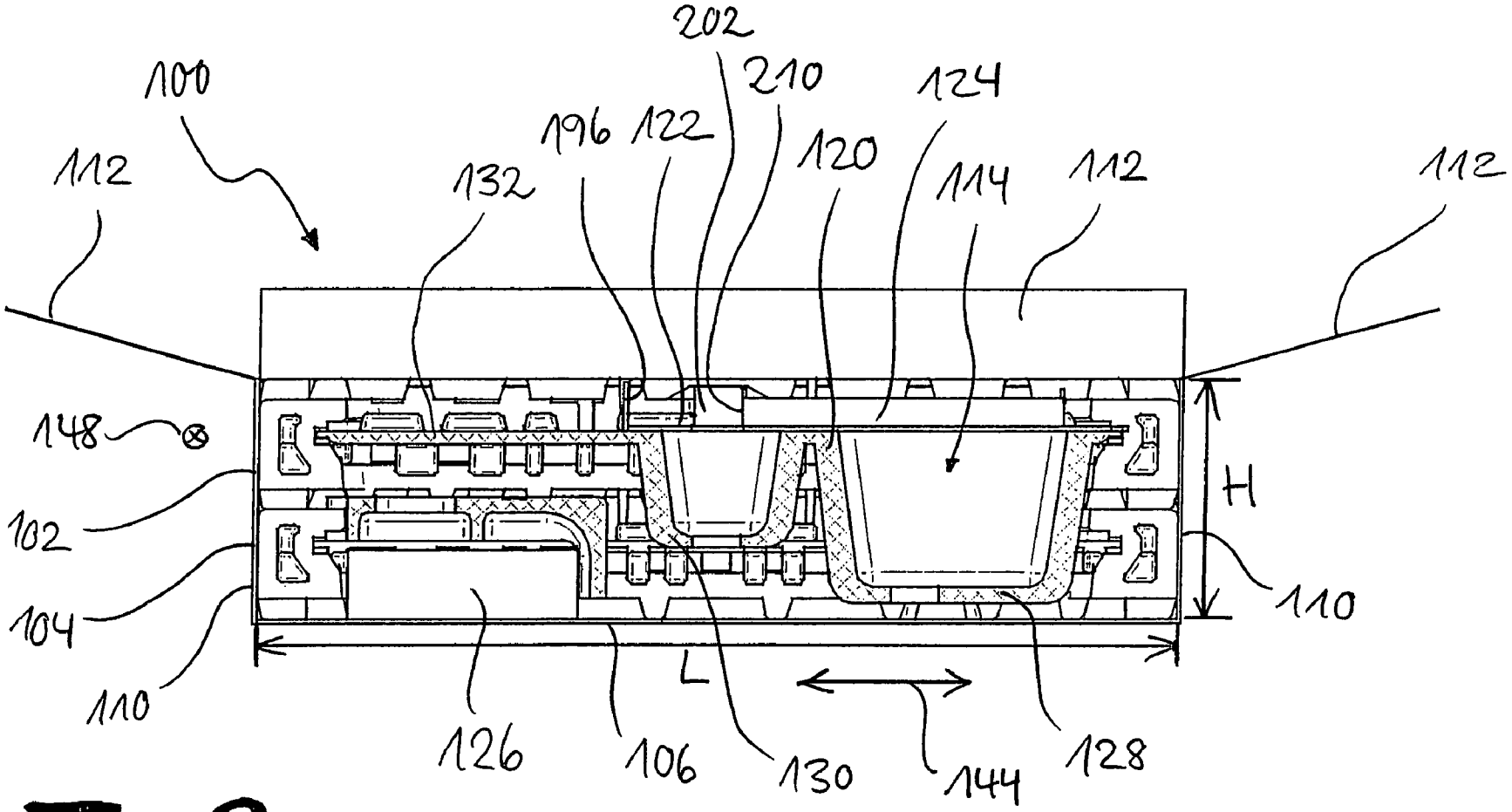
FIG. 2 a schematic vertical longitudinal section through the sink packaging depicted in FIG. 1.

In this example, as can best be seen from the sectional view of FIG. 2, the packaged sink 120 comprises a deep main basin 128, a less deep auxiliary basin 130 and a substantially flat, horizontal draining surface 132.

Figure 7:
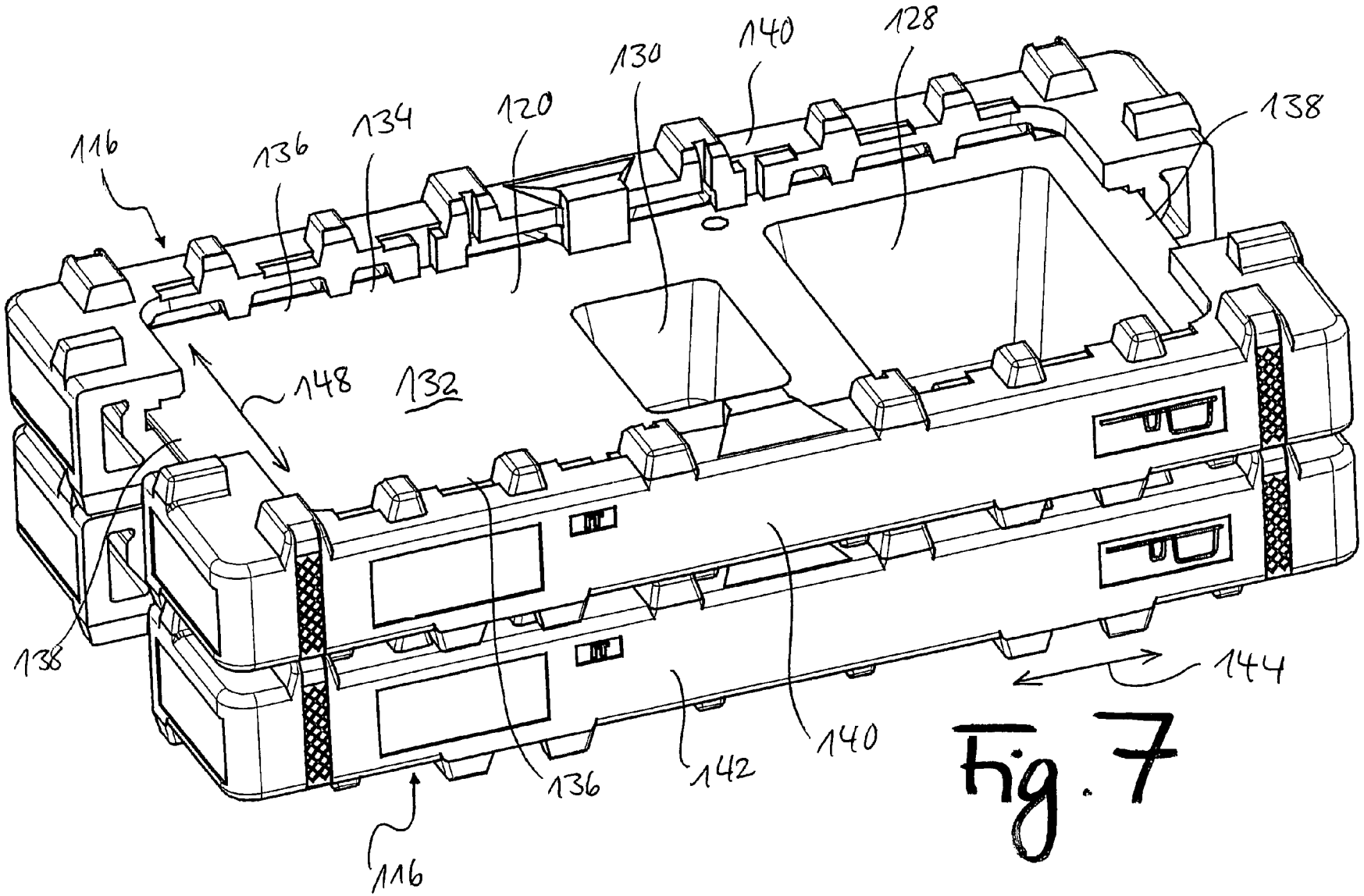
FIG. 7 a schematic perspective illustration from above of the sink packaging without the outer packaging, the cutting board box and the basin cover.
Figure 8:
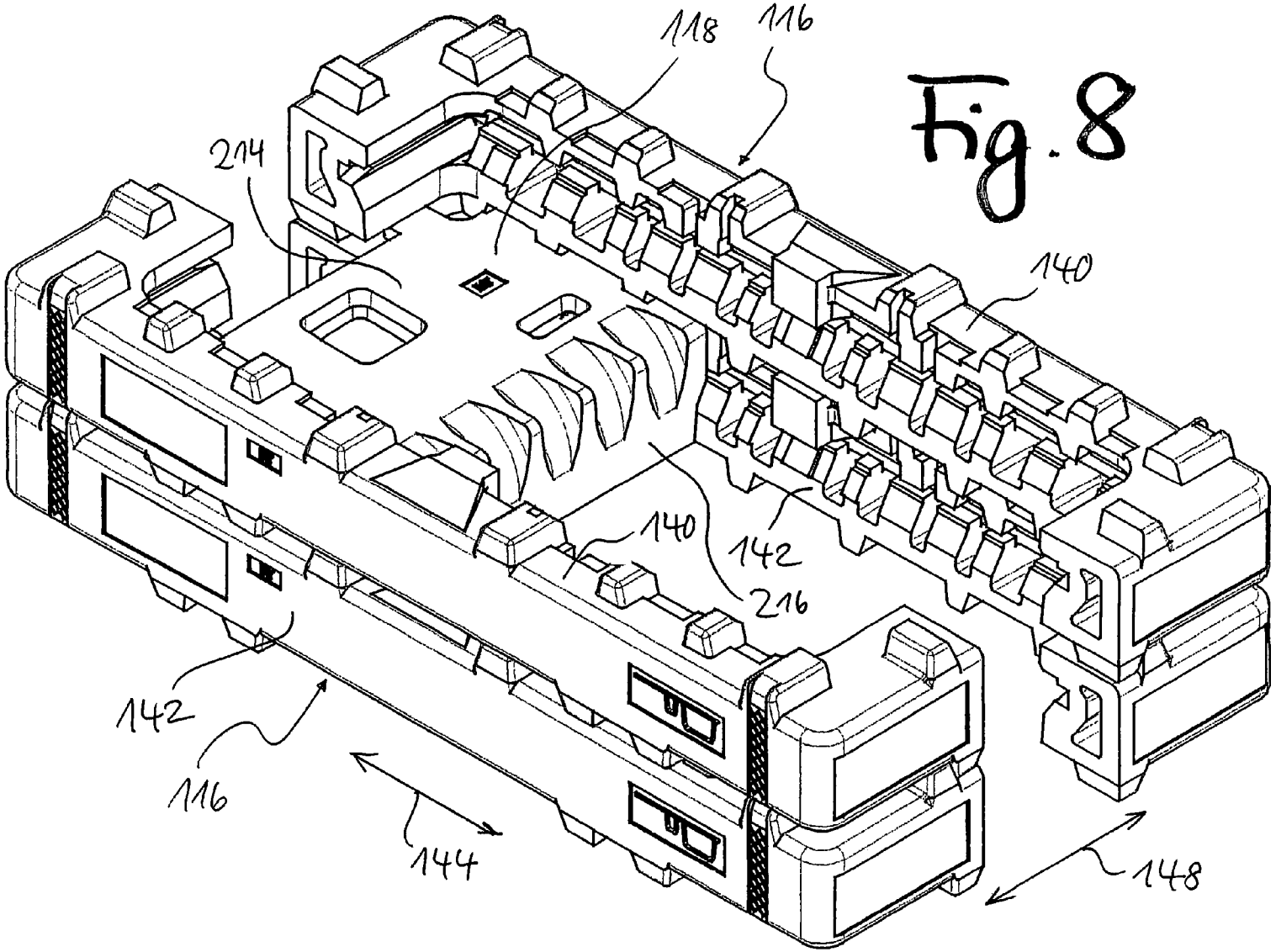
FIG. 8 a schematic-perspective illustration from above of the two supporting bodies of the sink packaging and of the intermediate element interconnecting the supporting bodies.

A substantially horizontal sink edge 134 extends around the main basin 128, the auxiliary basin 130 and the draining surface 132 and it comprises two long edge sections 136 which extend in parallel with the two long sides of the sink 120, and two short edge sections 138 which extend along the two short sides of the sink 120 (FIG. 7).

Each of the two supporting bodies 116 of the sink packaging 100 comprises a seating element 140 and a distance maintaining element 142, wherein the seating element 140 rests upon the upper surface of the distance maintaining element 142 while the seating element 140 and the distance maintaining element 142 are of identical shape and alignment.

Furthermore, the two supporting bodies 116 of the sink packaging 100 only differ from one another by virtue of the fact that they are rotated relative to one another through an angle of 180° about a vertical axis.

Thus, in toto, the two supporting bodies 116 of the sink packaging 100 comprise four elements of identical shape, namely, two seating elements 140 and two distance maintaining elements 142.

The construction of these four mutually identical elements is described in detail hereinafter with reference to FIGS. 14 to 22 on the basis of the example of a seating element 140:

The seating element 140 is in the form of a substantially U-shaped seating strip having a central section 146 which extends in the longitudinal direction 144 of the seating element 140 and two end sections 150 which extend along a transverse direction 148 of the seating element 140 that is aligned horizontally and perpendicularly relative to the longitudinal direction 144.

Figure 19:
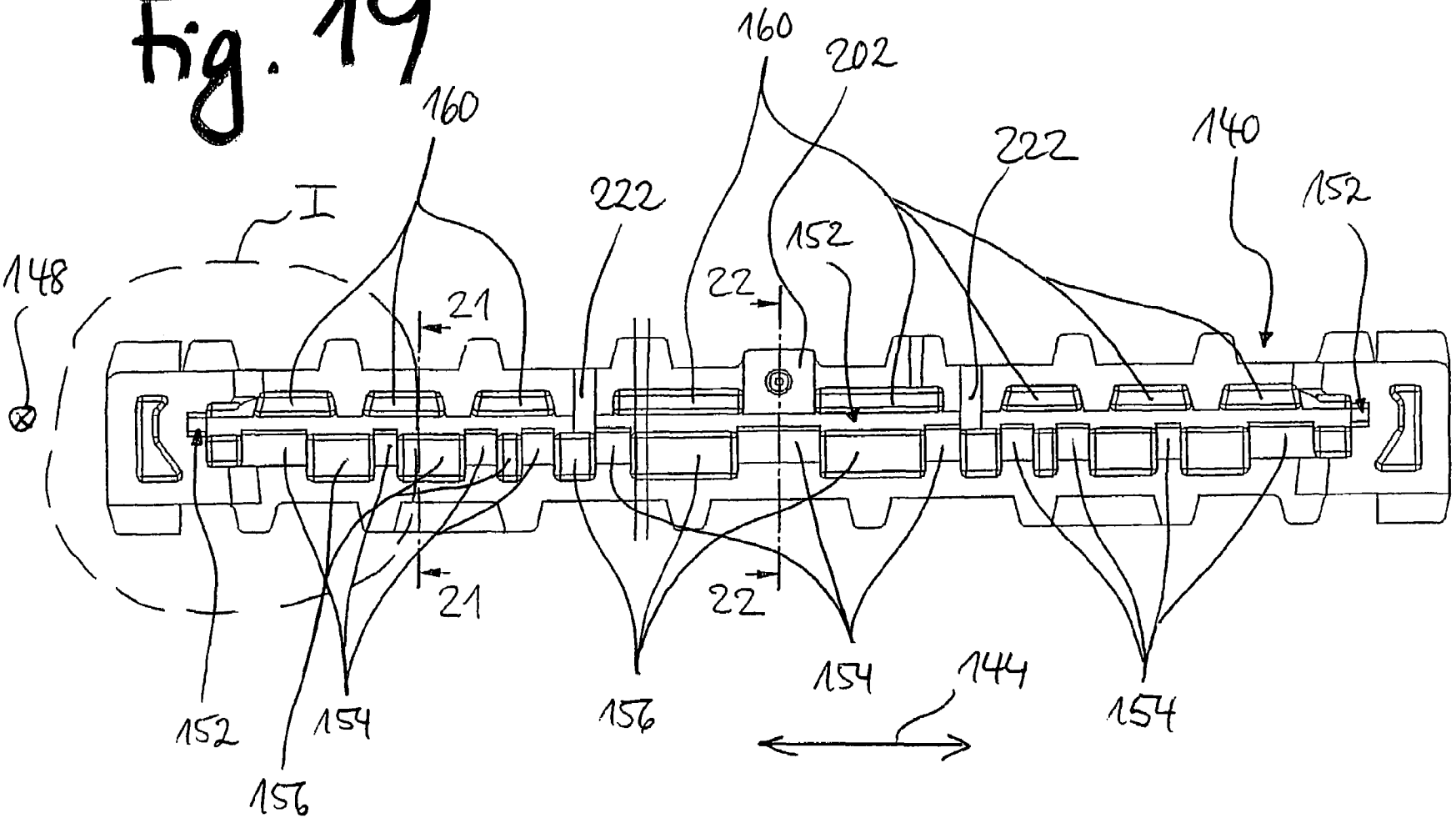
FIG. 19 a schematic side view of the seat element as seen from the inner surface of the seating element facing the sink.

As can best be seen from FIG. 19, the seating element 140 is provided with a seating channel 152 which is formed by a groove that runs approximately centrally in the horizontal direction on the inner surfaces of the central section 146 and the end sections 150 facing the sink 120.

This seating channel 152 is limited downwardly by a plurality of seat projections 154 which follow one another in the longitudinal direction 144 of the seating element 140, wherein in each case, two successive seat projections 154 are separated and spaced from one another by a recess 156 that is arranged between them and extends downwardly from the seating channel 152.

The seating channel 152 is limited upwardly by a plurality of channel delimiting projections 158 which succeed one another in the longitudinal direction 144 of the seating element 140, wherein in each case, two channel delimiting projections 158 that succeed one another in the longitudinal direction 144 are separated and spaced from each other by a respective recess 160 which is arranged between them and extends upwardly from the seating channel 152.

When packaging the sink 120, the seating element 140 is pushed onto the edge of the sink in such a way that a long edge section 136 of the edge of the sink 134 engages in the central section of the seating channel 152 and parts of the short edge sections 138 of the edge of the sink 134 engage in the end sections of the seating channel 152.

The sink 120 thereby rests on the seat projections 154 of the seating element 140 through the intermediary of the lower surface of the edge of the sink 143.

If the sink 120 is provided on the lower surface thereof with retaining element protuberances, then provision can be made, in particular, for the sink 120 to be supported via these retaining element protuberances on the seat projections 154 of the seating element 140. In this case, the seating element 140 is not pushed onto the edge of the sink 134 to such an extent that the edge of the sink 134 rests on the rear surface of the seating channel 152, but only so far as to allow the retaining element protuberances to rest on the respectively associated seat projections 154. Consequently, the end position of the seating elements 140 relative to the sink 120 is determined only by the position of the retaining element protuberances and not by the distance by which the edge of the sink 134 projects outwardly beyond the retaining element protuberances. Thus, in this case, the spacing between the two mutually opposite supporting bodies 116 of the sink packaging 100 is also dependent only on the spacing between the mutually opposite retaining element protuberances and not on the total width of the sink (namely, the extent thereof perpendicularly to the longitudinal direction of the sink), whereby it is then possible to obtain the same width of sink packaging 100 for sinks 120 of differing widths so that the selfsame outer packaging 102 can be used for sinks which differ in width.

Moreover, it is thereby possible for the same seating elements 140 to be used for sinks 120 of differing widths.

In each case, the edge of the sink 134 is supported on the seating element 140 only on the seat projections 154 and not in the region of the recesses 156 lying therebetween, so that the edge of the sink 134 only rests partially upon the seating element 140.

Furthermore, the upper surface of the edge of the sink 134 also comes into contact with the seating element 140 only in the vicinity of the channel delimiting projections 158, but not in the region of the recesses 160 therebetween.

Due to this merely partial contact between the lower surface and the upper surface of the edge of the sink 134 and the seating element 140, the effect is achieved that shock loadings which are effective on the seating element 140 will only be transferred to the sink 120 to a reduced extent.

In principle, provision could be made for each of the channel delimiting projections 158 on the upper surface of the seating channel 152 to be located opposite a respective one of the seat projections 154 on the lower surface of the seating channel 152.

In a preferred embodiment of the seating element 140 however, provision is made for at least some of the channel delimiting projections 158 on the upper surface of the seating channel 152 to be displaced in relation to the seat projections 154 on the lower surface of the seating channel 152 in such a way that these channel delimiting projections 158 are at least partly opposite to one of the recesses 156 in the lower surface of the seating channel 152.

Figure 20:
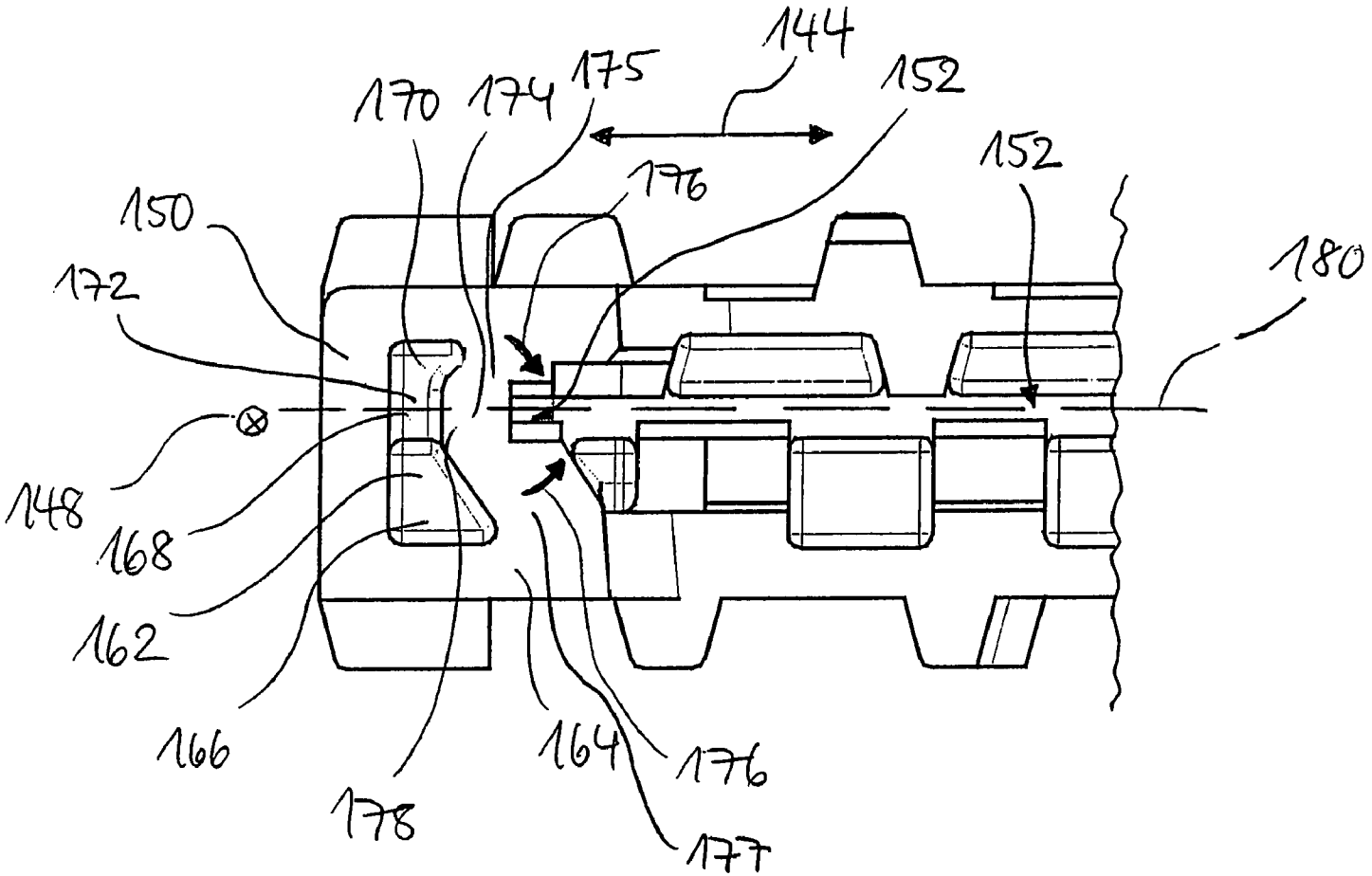
FIG. 20 an enlarged illustration of the region I depicted in FIG. 19.
Figure 21:
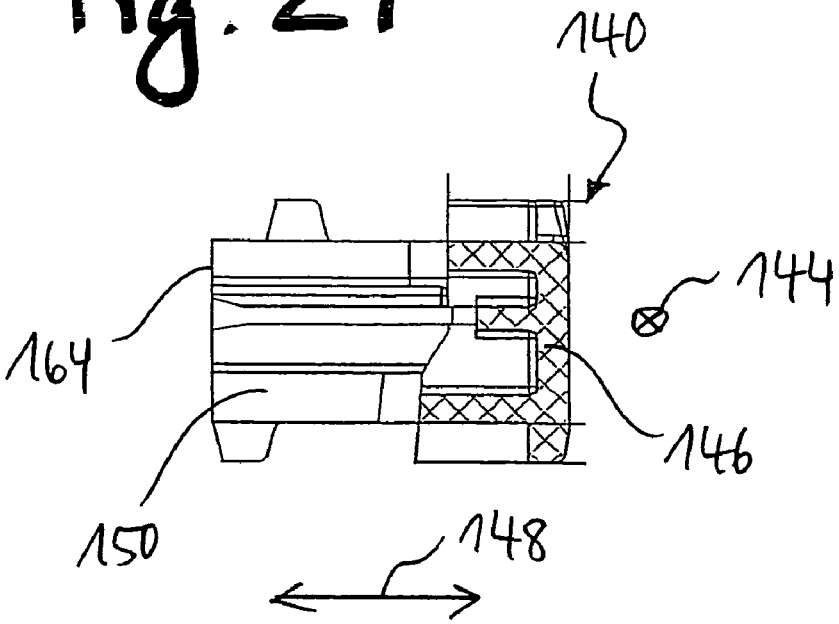
FIG. 21 a schematic vertical cross section through the seating element along the line 21—21 in FIG. 19.
Figure 22:
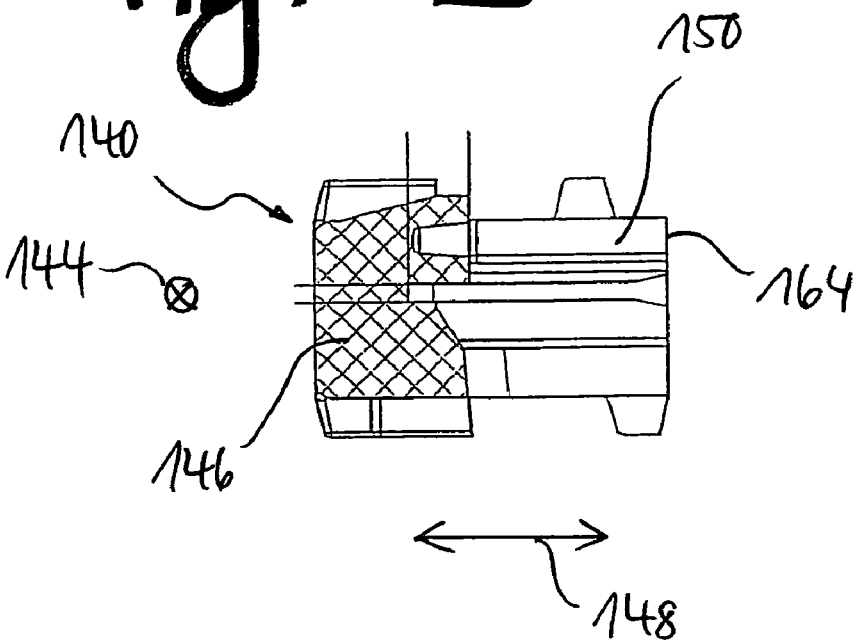
FIG. 22 a schematic vertical cross section through the seating element along the line 22—22 in FIG. 19.
Figure 26:
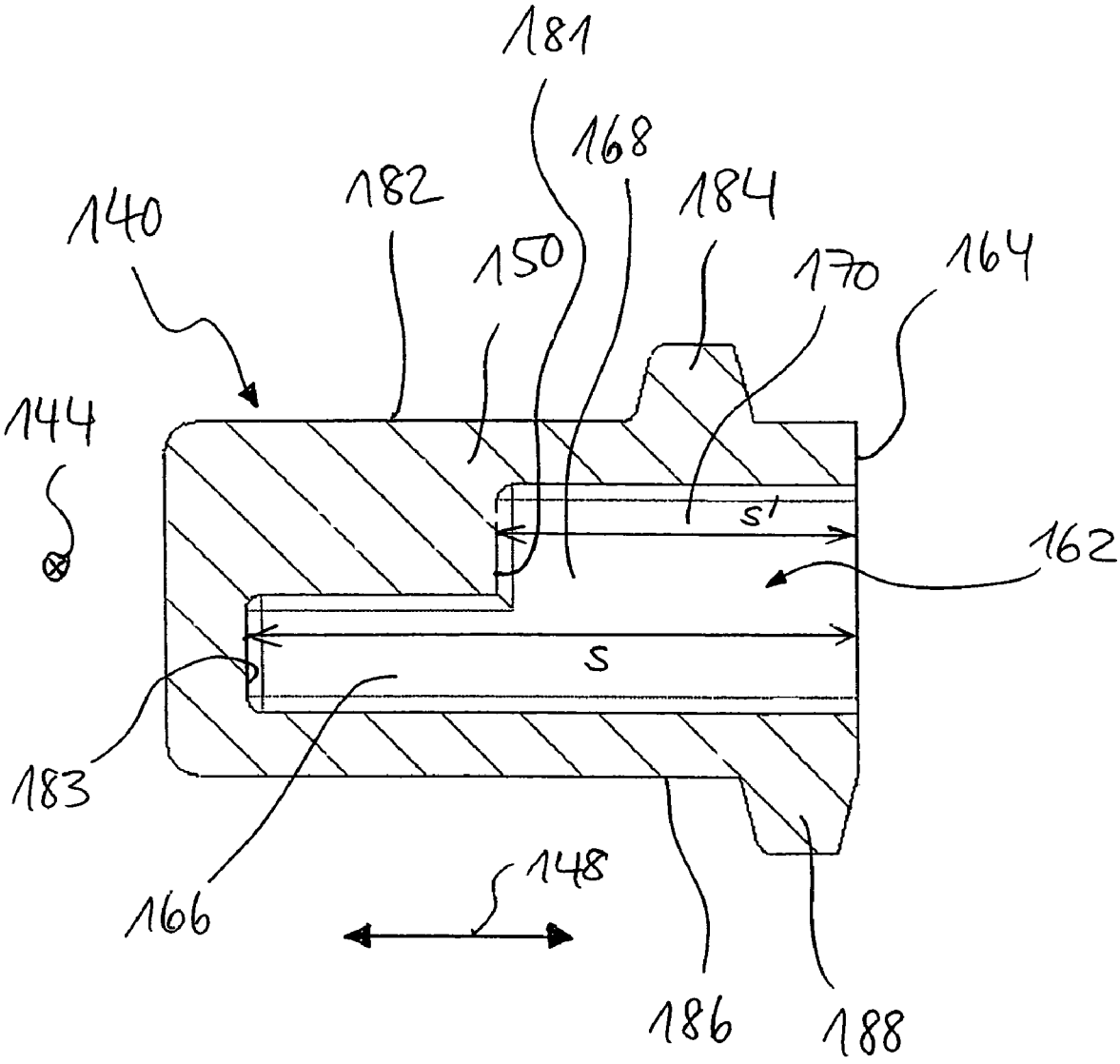
FIG. 26 a schematic vertical longitudinal section through an end section of a seating element.
Figure 27:
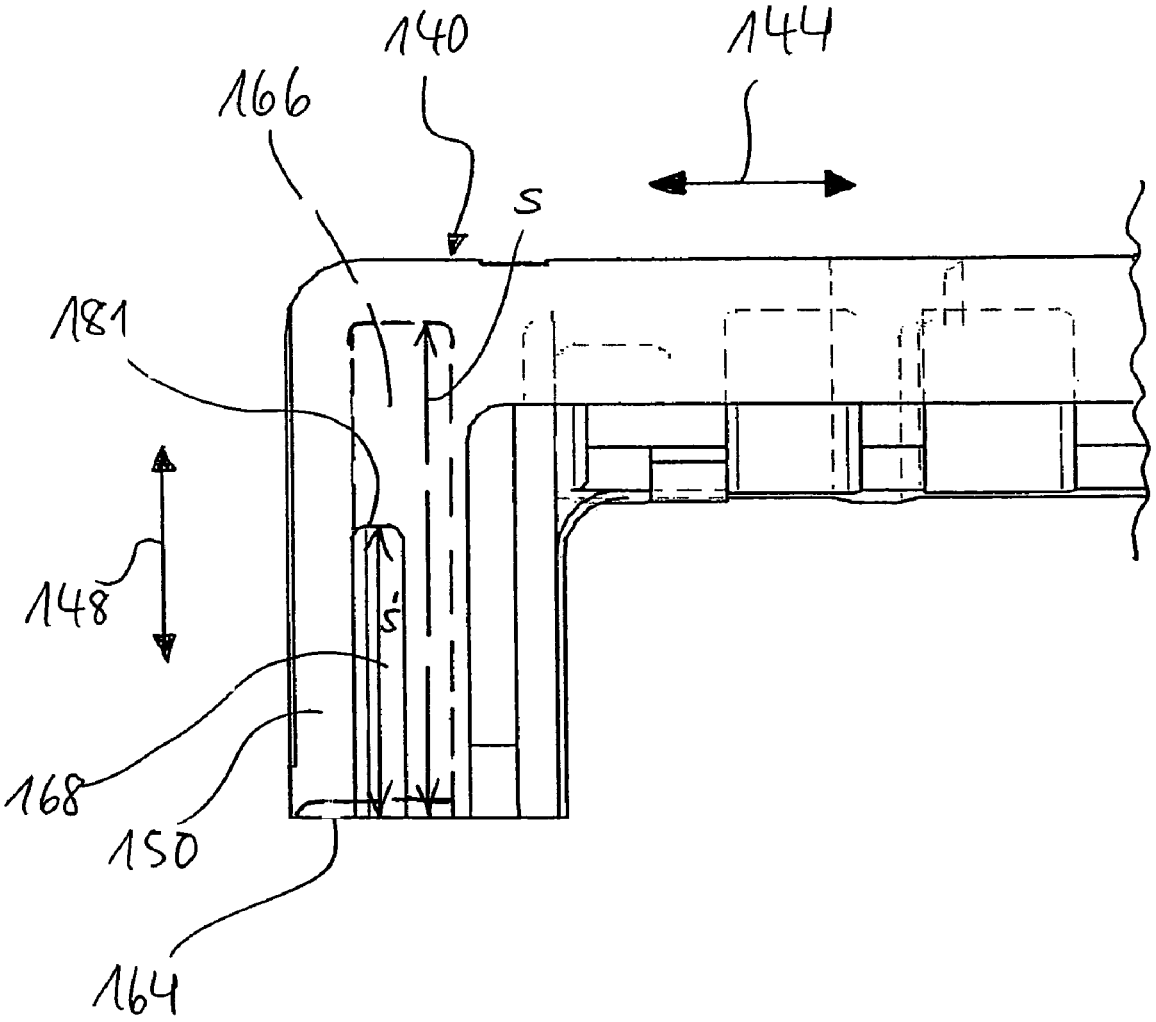
FIG. 27 a schematic horizontal longitudinal section through the end section of a seating element.

As can best be seen from FIGS. 20, 26 and 27, the end sections 150 of the seating element 140 are provided with a respective cavity 162 which is open only towards the end-side end face 164 of the end section 150.

The cavity 162 comprises a lower region 166 having a substantially trapezoidal vertical cross section which widens downwardly and towards the inner surface of the end section 150 facing the sink 120, an upwardly extending middle region 168 which adjoins the lower region 166 and has a substantially rectangular vertical cross section, and an upwardly extending upper region 170 which adjoins the middle region 168 and has a substantially trapezoidal vertical cross section that widens upwardly and towards the inner surface of the end section 150 facing the sink 120.

The cross-sectional area of the upper region 170 is significantly smaller than the cross-sectional area of the lower region 166.

The middle region 168 of the cavity 162 lying therebetween forms a constriction 172 of the cavity which is formed by virtue of the inner wall 174 of the end section 150 facing the sink 120 protruding into the cavity 162.

Moreover, this inner wall 174 protruding into the cavity 162 is weakened at the side thereof facing the sink 120 by a recess, namely the seating channel 152.

Due to this design of the end section 150, the effect is achieved that the upper section 175 of the inner wall 174 and the lower section 177 of the inner wall 174 can be pivoted somewhat about the central section 178 of the inner wall 174 protruding into the cavity 162 in a direction towards the horizontal plane 180 of the seating element 140 extending through the central section 178 by exerting pressure on the seating element 140, this thereby entailing an increased absorption effect for the seating element 140 in regard to impulsive forces that are effective on the seating element 140 in the vertical direction.

As can best be seen from FIGS. 26 and 27, the lower region 166 of the cavity 162 extends into the end section 150 of the seating element 140 from the end-side end face 164 over a distance s in the transverse direction 148, said distance s being significantly greater than the distance s' by which the upper region 170 and the middle region 168 of the cavity 162 extend into the end section 150 of the seating element 140 from the end-side end face 164 in the transverse direction 148.

The distance s can, in particular, be larger than the distance s' by at least 50%.

Due to the differing extents of the different regions 166, 168 and 170 of the cavity 162 in the transverse direction 148, a step 181 is formed at the rear surface of the upper region 170 and the middle region 168 of the cavity 162 remote from the end-side end face 164 of the end section 150, whereby the entire vertical cross section of the cavity 162 increases sharply (as seen in the direction towards the end-side end face 164) at said step.

Due to this design of the cavity 162, the cavity 162 widens towards the end face 164 of the end section 150.

As a result of the cavity 162 having a smaller vertical cross section at the end thereof remote from the end face 164 of the end section 150 than at the end thereof facing the end face 164, the mechanical stability of the end section 150 is increased in comparison with an end section having a cavity that is of constant vertical cross section in the transverse direction 148.

In the region from the end face 164 up to the step 181, the vertical cross section of the cavity 162 is substantially constant in the transverse direction 148.

In like manner, the vertical cross section of the cavity 162 is substantially constant in the transverse direction 148 in the region between the step 181 and the rear delimiting surface 183 of the lower region 166 of the cavity 162 remote from the end face 164.

Figure 14:
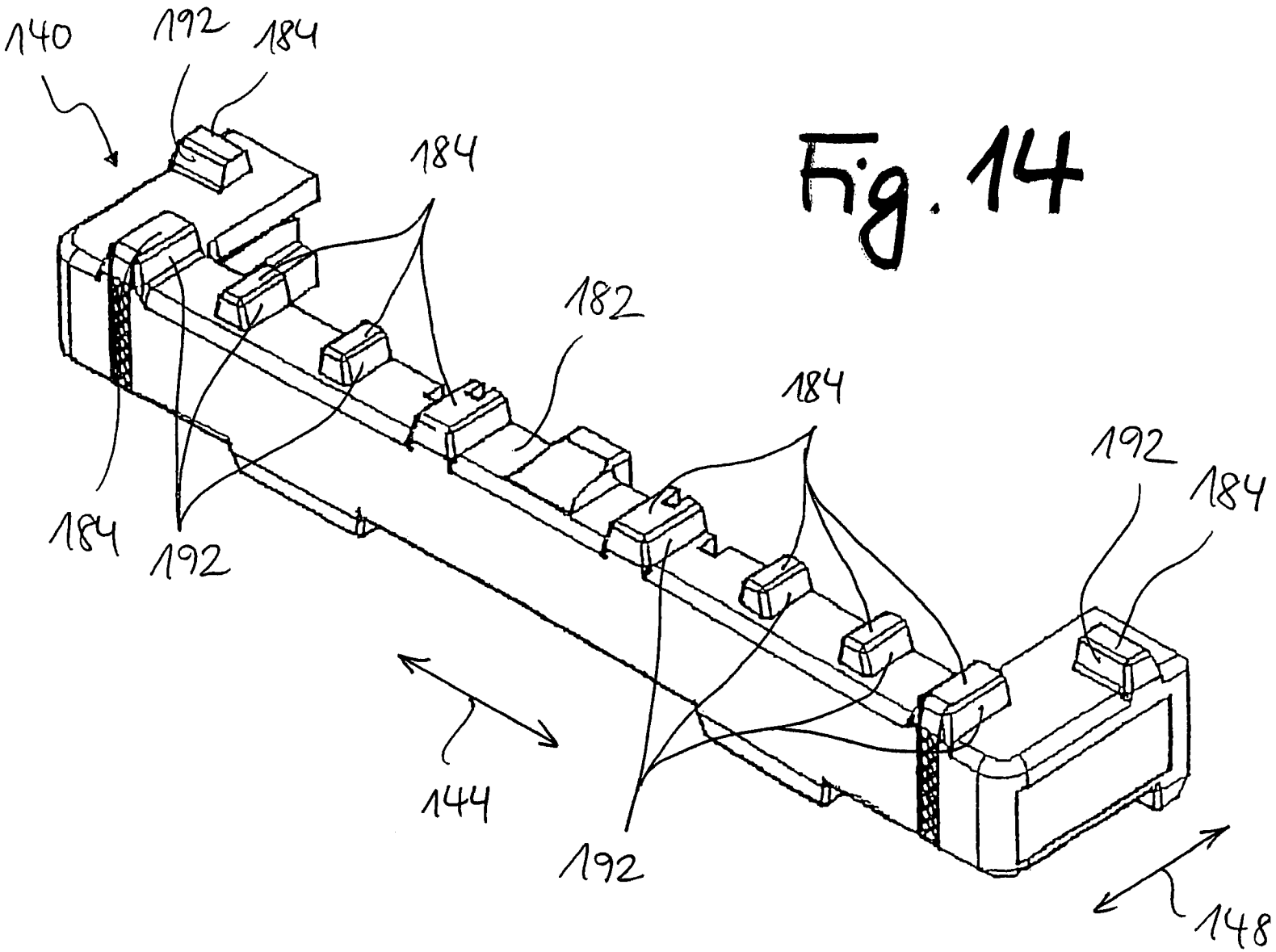
FIG. 14 a schematic perspective illustration of a seating element of the sink packaging as seen from above and from the outer surface of the seating element remote from the sink.
Figure 15:
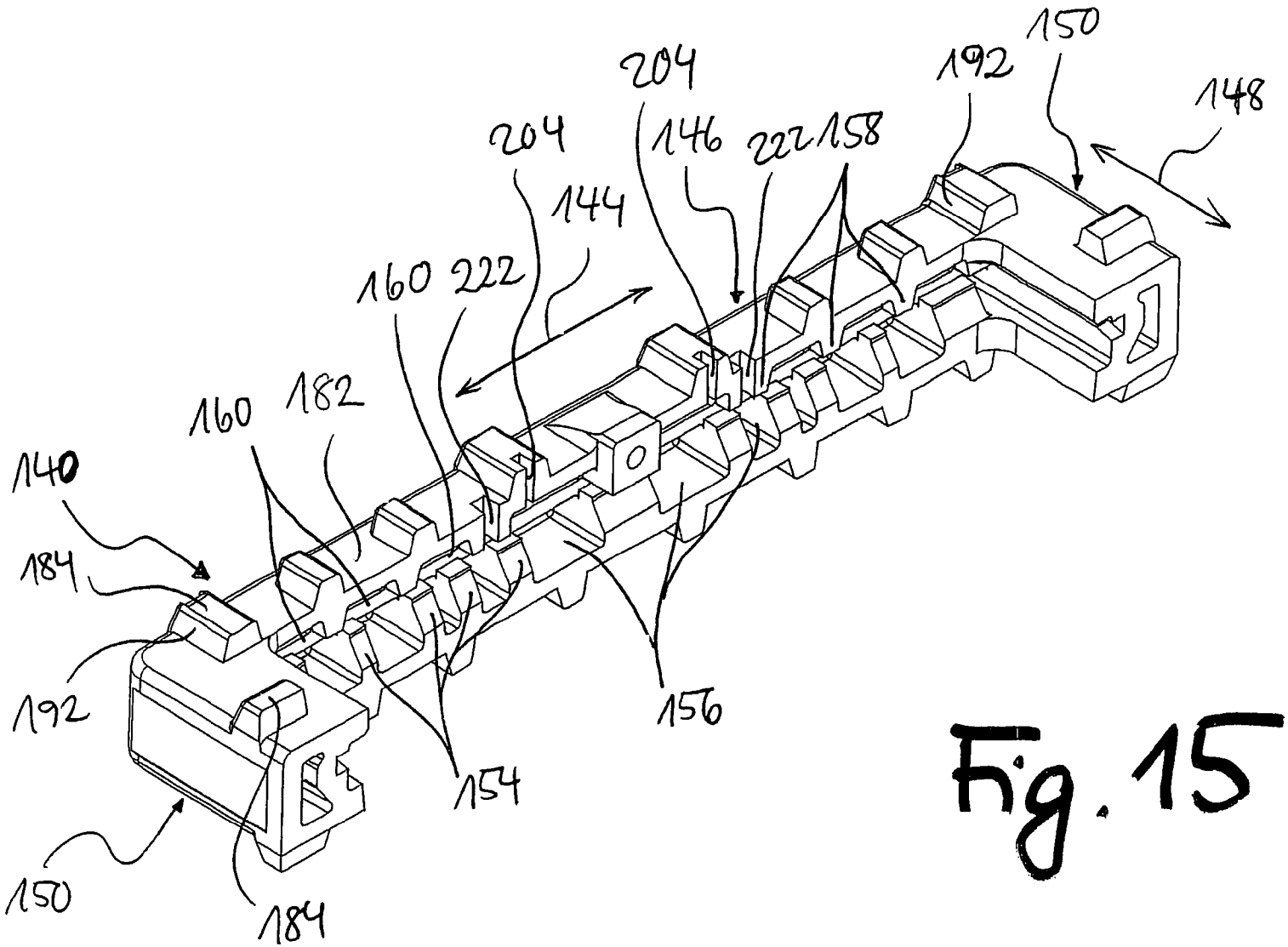
FIG. 15 a schematic perspective illustration of the seating element as seen from above and from the inner surface of the seating element facing the sink.
Figure 17:
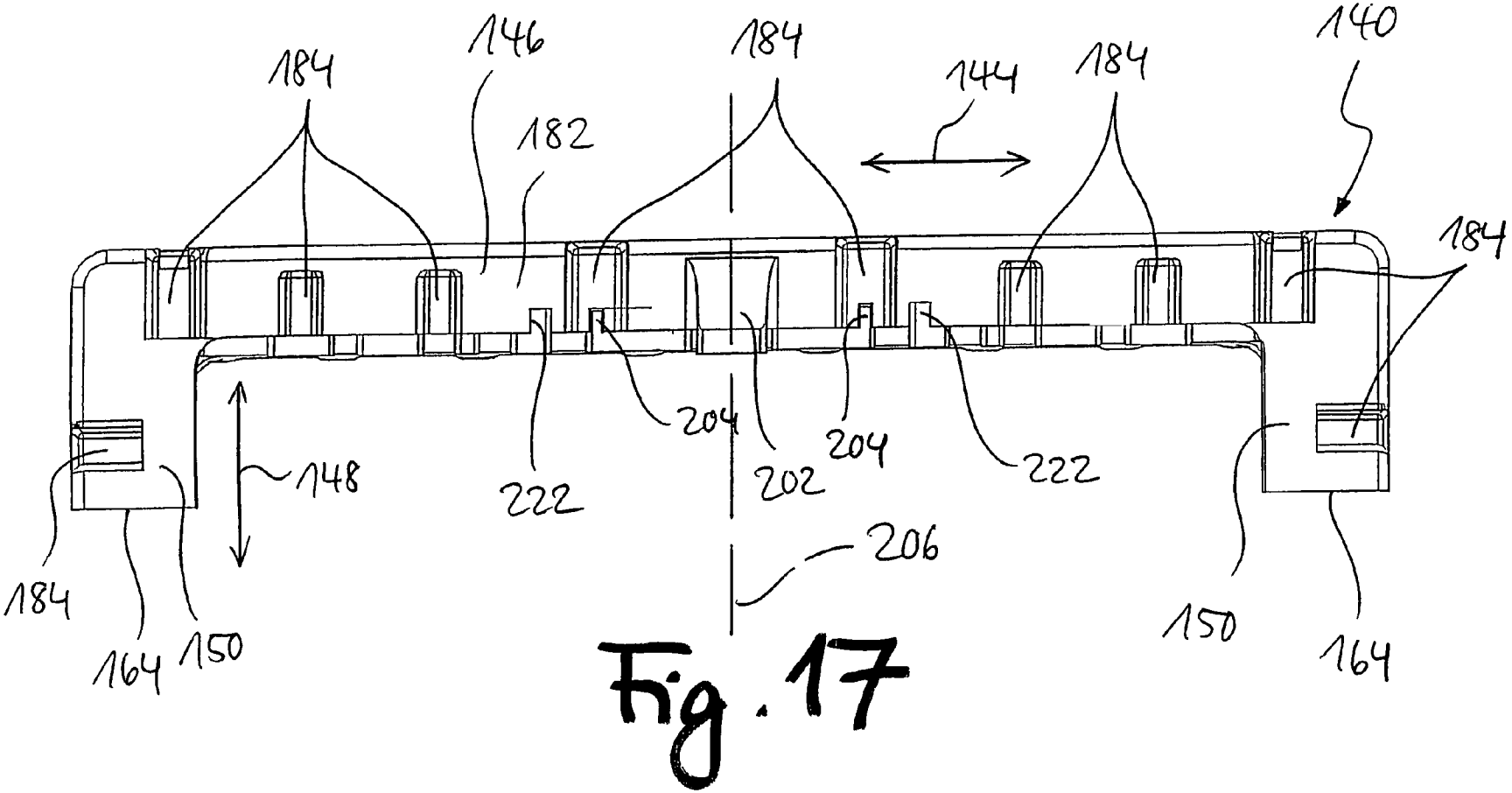
FIG. 17 a schematic plan view of the seating element from above.

As can best be perceived from FIGS. 14, 15 and 17, the upper surface 182 of the seating element 140 (and hence too, that of the distance maintaining element 142) is provided with a plurality of projections 184 which extend upwardly from the upper surface 182.

Figure 16:
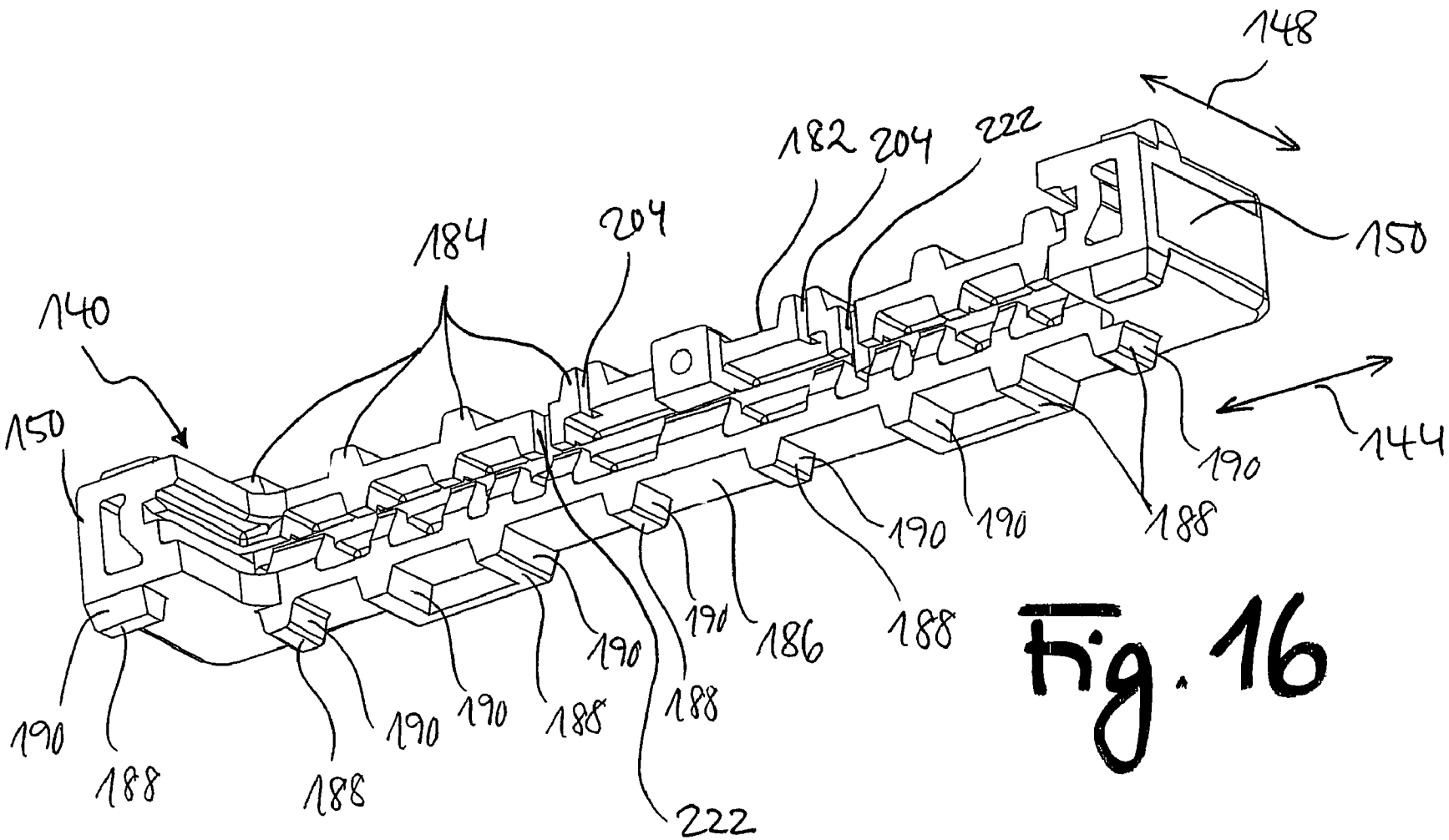
FIG. 16 a schematic perspective illustration of the seating element as seen from below and from the inner surface of the seating element facing the sink.
Figure 18:
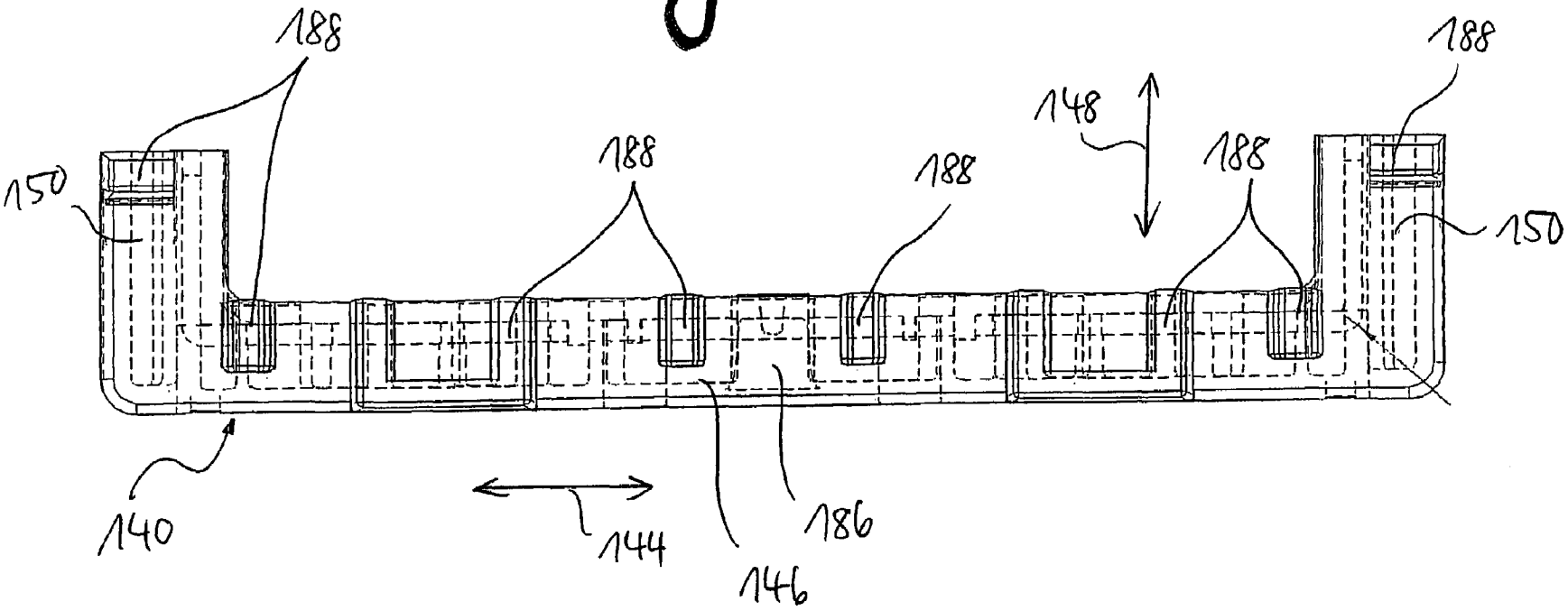
FIG. 18 a schematic plan view of the seating element from below.

As can best be seen from FIGS. 16 and 18, the lower surface 186 of the seating element 140 (and hence too, that of the distance maintaining element 142) is likewise provided with a plurality of projections 188 which extend downwardly from the lower surface 186.

Here, the vertical extent of the projections 188 on the lower surface 186 is of substantially the same size as the vertical extent of the projections 184 on the upper surface 182 so that, when the seating element 140 is placed on the identically formed distance maintaining element 142, the projections 188 on the lower surface 186 of the seating element 140 rest flatly on the upper surface 182 of the distance maintaining element 142 and, at the same time, the projections 184 on the upper surface 182 of the distance maintaining element 142 rest flatly on the lower surface 186 of the seating element 140.

Furthermore, the projections 188 on the lower surface 186 and the projections 184 on the upper surface 182 are displaced from one another in such a manner that, when the seating element 140 is placed on the identically formed distance maintaining element 142, each of the vertically inclined side faces 190 of the projections 188 on the lower surface 186 of the seating element of 140 then rests flatly on one of the inclined side faces 192 of a neighbouring projection 184 on the upper surface 182 of the distance maintaining element 142.

Since the projections 184, 188 extend partially transversely relative to the longitudinal direction 144 and partially transversely relative to the transverse direction 148 of the seating element 140, the projections 188 on the lower surface 186 of the seating element 140 and the projections 184 on the upper surface 182 of the distance maintaining element 142 thus cooperate with one another in a manner such that the seating element 140 and the distance maintaining element 142 are safeguarded from relative movement in the longitudinal direction 144 of the seating element 140 or of the distance maintaining element 142 as well as in the transverse direction 148 of the seating element 148 or of the distance maintaining element 142 and thus can only be released from one another by a relative movement in the vertical direction.

The seating elements 140 and the distance maintaining elements 142 of the sink packaging 100 are preferably in the form of one-piece moulded articles made from a foamed plastic material, and in particular, from an expanded polystyrene material.

Furthermore, the sink packaging 100 comprises the basin cover 122 which rests upon the upper surface of the sink 120 and covers both the main basin 128 and the auxiliary basin 130 of the sink 120. The accessories accommodated in the main basin 128 or in the auxiliary basin 130 are thus prevented from moving about or falling out in this way.

Figure 6:
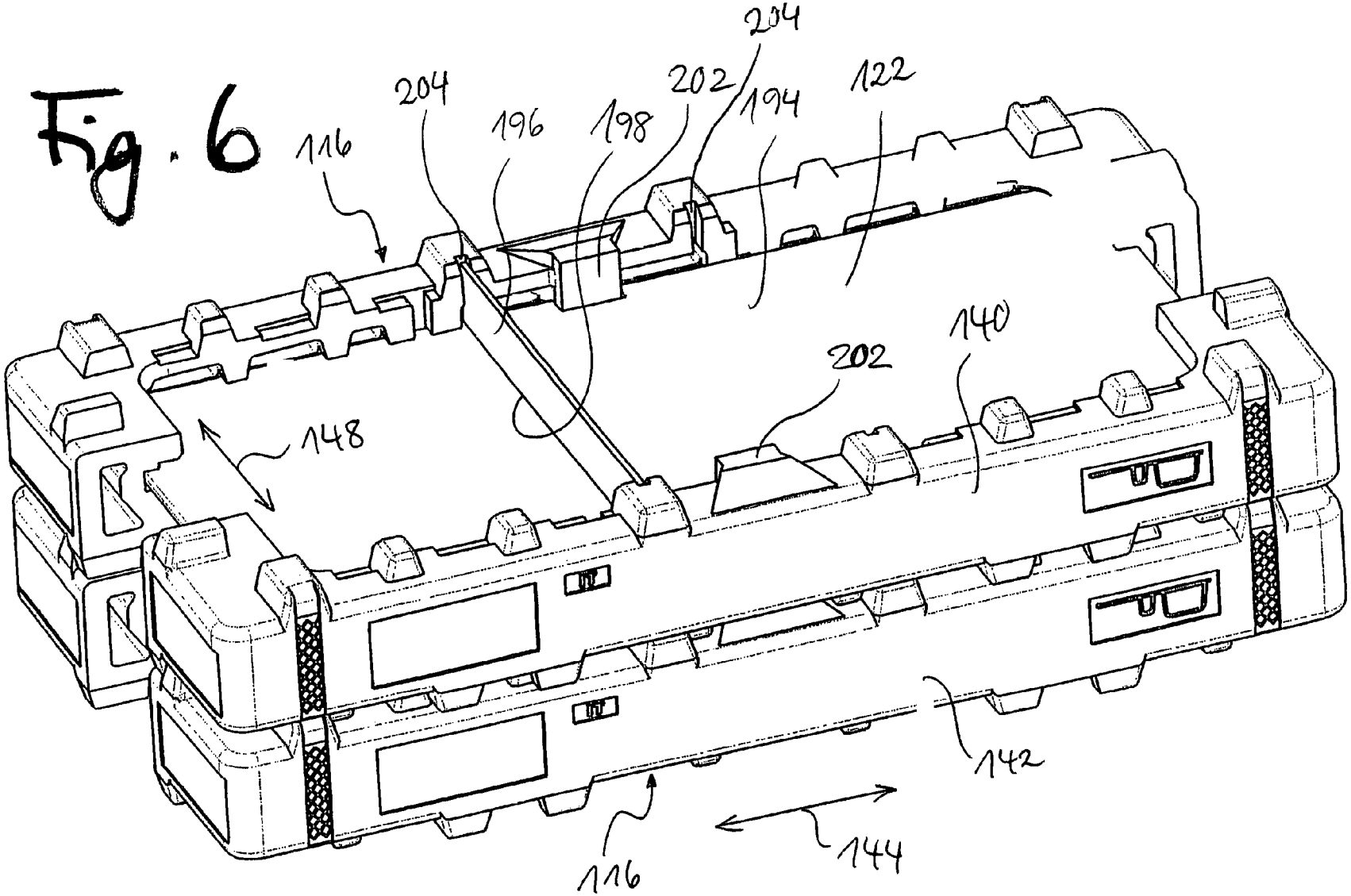
FIG. 6 a schematic perspective illustration from above of the sink packaging without the outer packaging and without the cutting board box.
Figure 9:
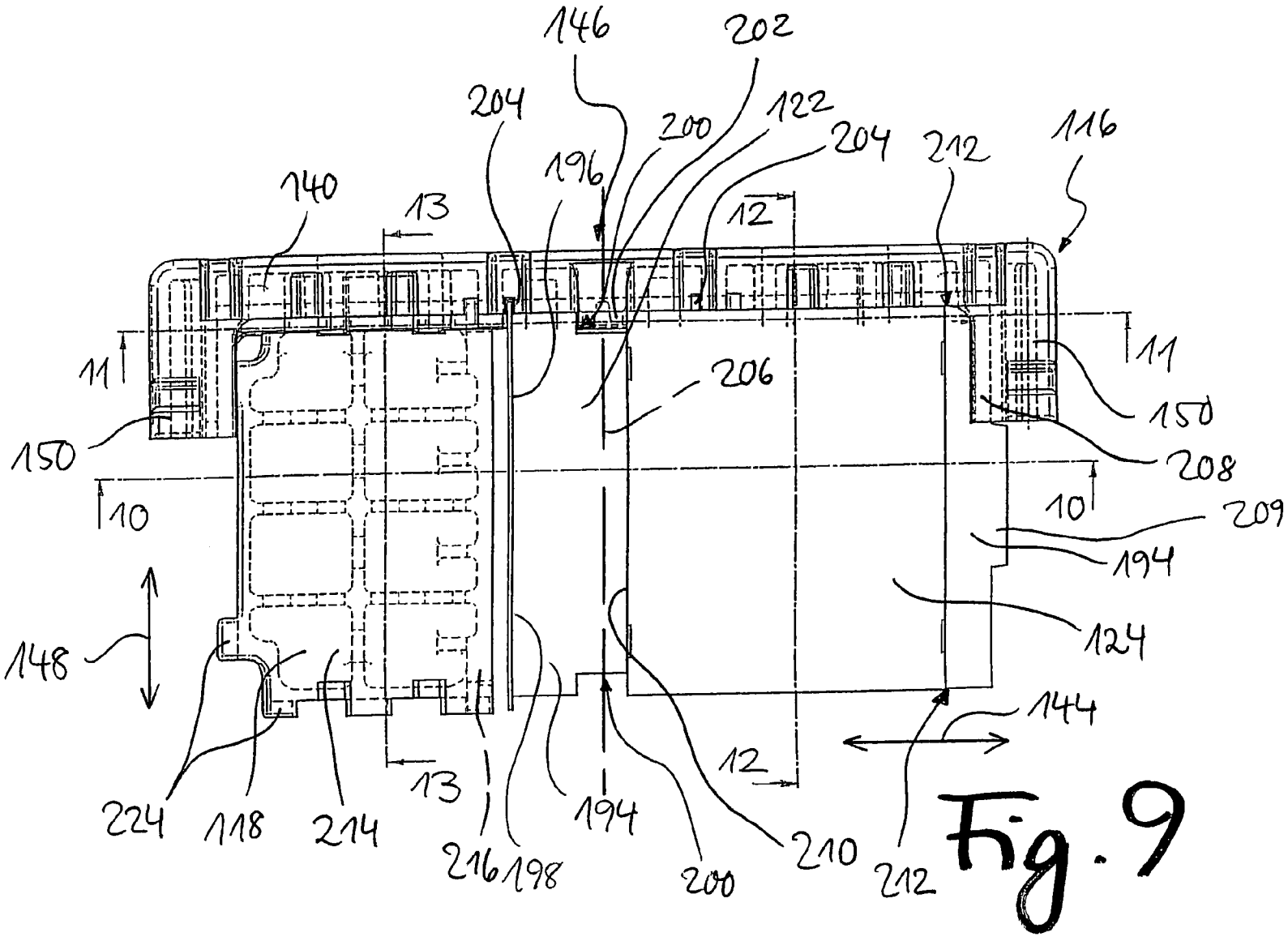
FIG. 9 a schematic plan view from above of one of the supporting bodies as well as of the intermediate element, the basin cover and the cutting board box.
Figure 10:
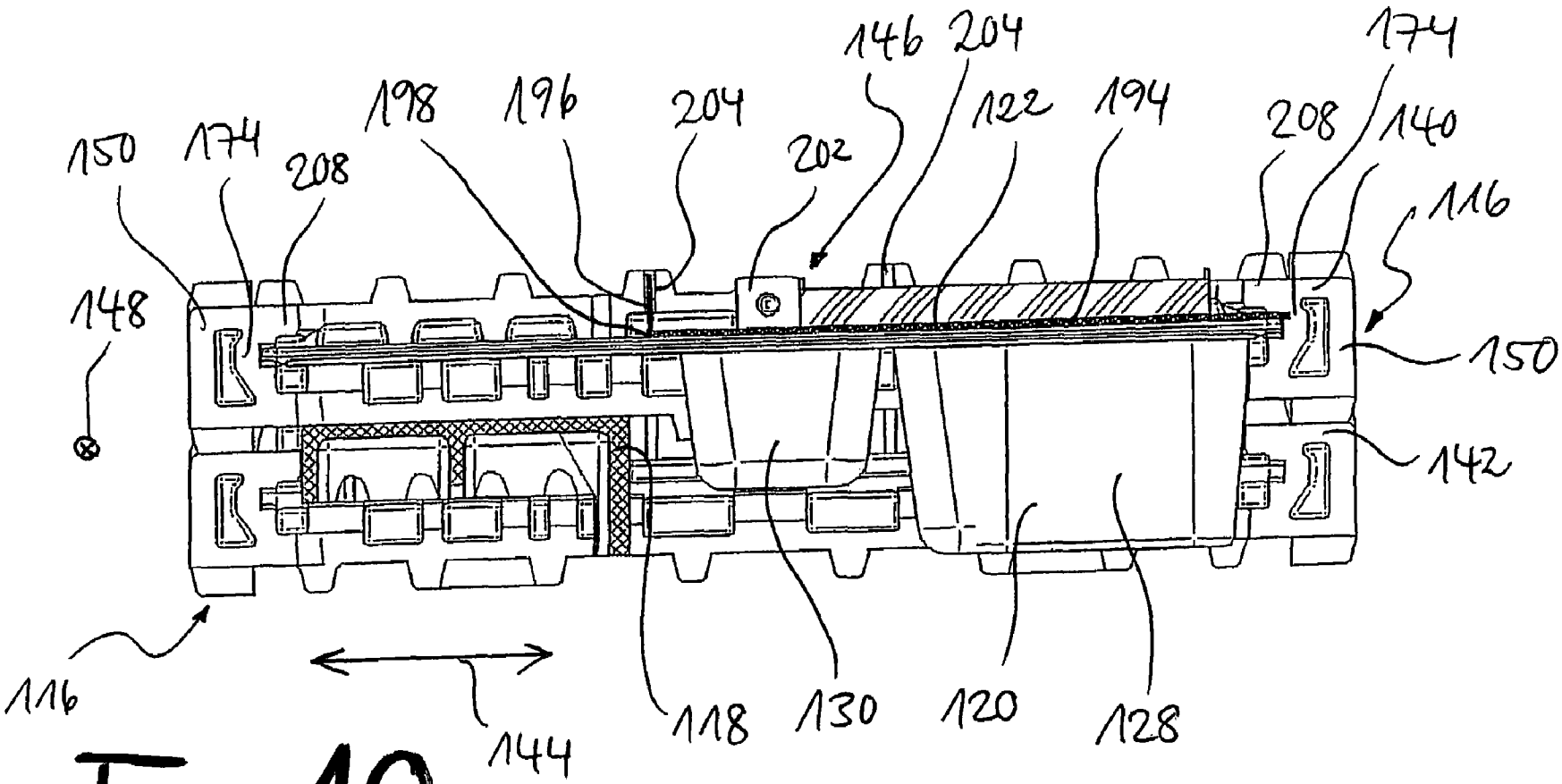
FIG. 10 a schematic vertical longitudinal section through the arrangement depicted in FIG. 9 along the line 10—10 in FIG. 9.
Figure 11:
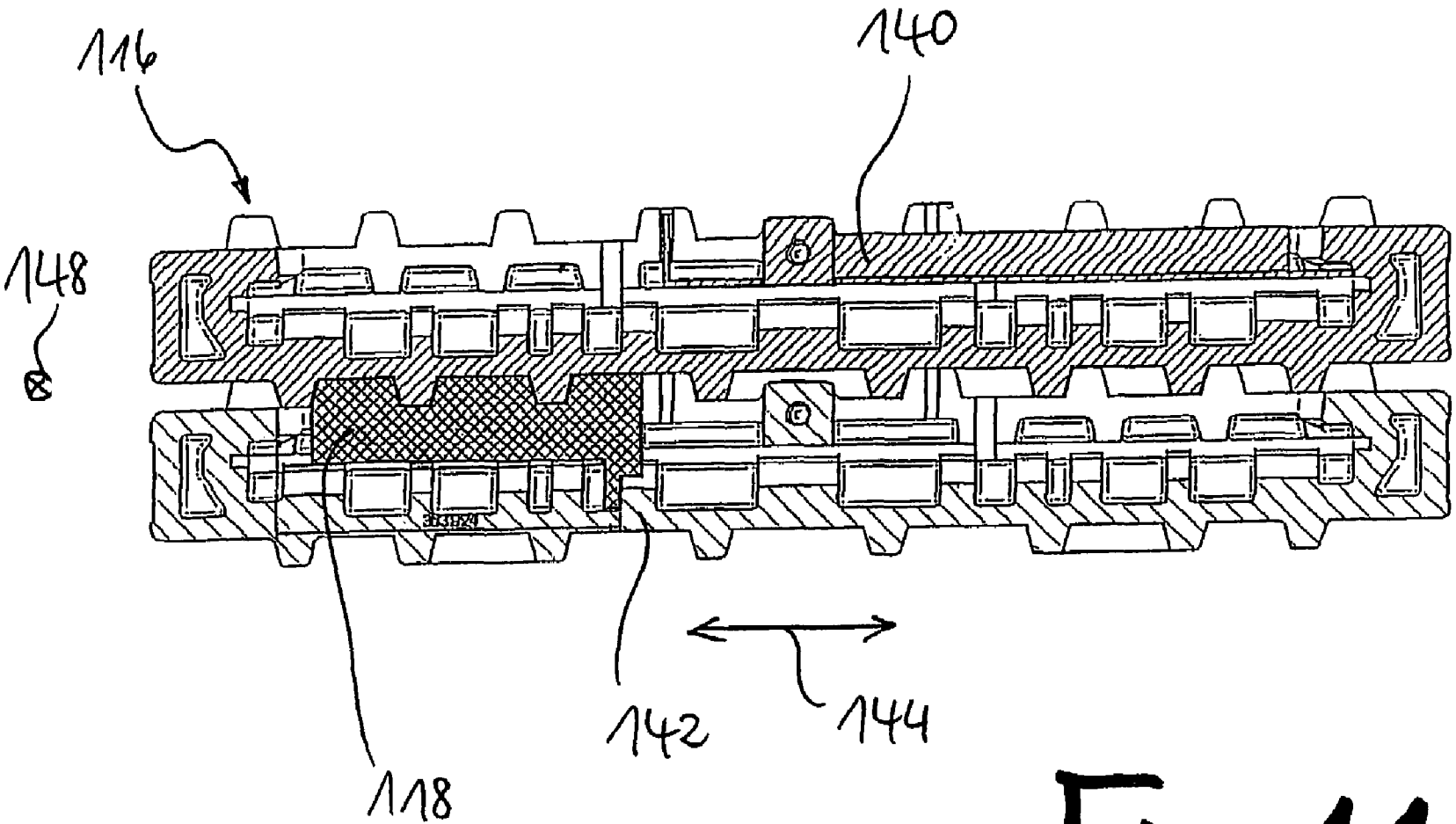
FIG. 11 a schematic vertical longitudinal section through the arrangement depicted in FIG. 9 along the line 11—11 in FIG. 9.
Figure 12:
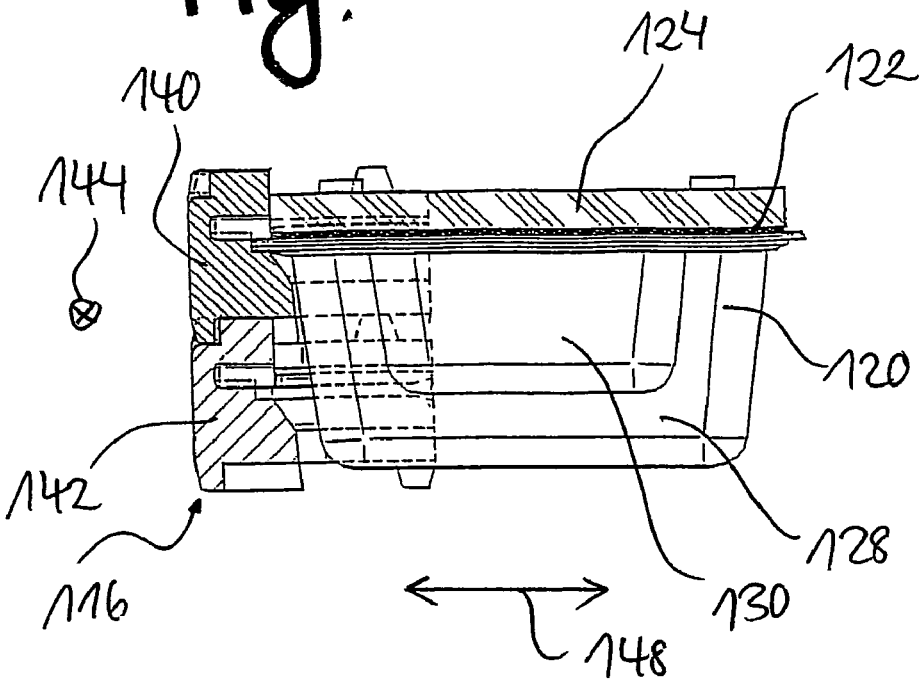
FIG. 12 a schematic vertical cross section through the arrangement depicted in FIG. 9 along the line 12—12 in FIG. 9.
Figure 13:
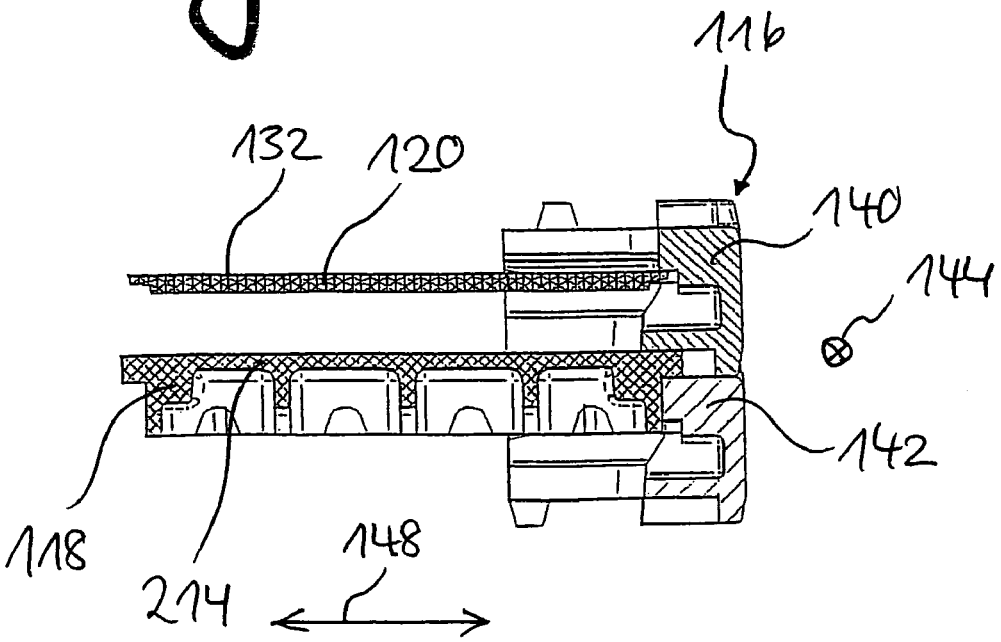
FIG. 13 a schematic vertical cross section through the arrangement depicted in FIG. 9 along the line 13—13 in FIG. 9.

As can best be seen from FIGS. 6, 9 and 10, the basin cover 122 comprises a substantially rectangular horizontal cover plate 194 and a likewise substantially rectangular vertical retaining plate 196 which is formed in one-piece with the horizontal cover plate 194 and is joined along a break line 198 to an edge of the horizontal cover plate 194 at the draining surface side.

The basin cover 122 is formed by a cardboard panel or a corrugated cardboard panel for example.

As can best be seen from FIG. 9, the horizontal cover plate 194 is provided at the lateral edges thereof with a respective substantially rectangular recess 200 which is formed in complementary manner to a stop block 202 arranged centrally on the inner surface of the central section 146 of a seating element 146 facing the sink 120.

Each of these stop blocks 202 engages in the respectively associated recess 200 of the horizontal cover plate 194 and thus safeguards the basin cover 122 from movement relative to the respective seating element 140 in the longitudinal direction 144 thereof and from movement relative to the two seating elements 140 in their common transverse direction 148.

Furthermore, a vertical seating groove 204 is provided on the inner surface of the central section 146 in each of the seating elements 140, a respective lateral edge of the vertical retaining plate 196 engaging in said groove. Hereby, the vertical retaining plate 196 and the seating grooves 204 of the seating elements 140 cooperate in such a way that the basin cover 122 is safeguarded from movement relative to the seating elements 140 in the longitudinal direction 144 thereof and in the transverse direction 148 thereof.

Furthermore, when the outer packaging 102 of the sink packaging 100 is closed, then the vertical retaining plate 196 and the top wall of the outer packaging 102 formed by the folding flaps 112 cooperate in such a way that the displacement path of the basin cover 122 is limited in the vertical direction The vertical seating groove 204 preferably extends into one of the projections 184 on the upper surface 182 of the seating element 140 since the vertical extent of the seating groove 204 and hence the contact area with the retaining plate 196 are thereby increased.

Since the seating elements 140 are mirror-symmetrical relative to the transverse central plane 206 thereof which extends centrally through the stop block 202, the seating groove 204 for the vertical retaining plate 196 of the basin cover 122 is doubly present in each seating element 140.

Furthermore, as is best seen from FIG. 10, the end sections 150 of each of the seating elements 140 is provided with a projection 208 which extends away in a horizontal direction from the inner wall 174 of the respective end section 150 and overlaps the rear free edge of the horizontal cover plate 194 remote from the vertical retaining plate 196 so that the basin cover 122 is prevented from being lifted off the upper surface of the sink 120 in the vertical direction.

Furthermore, as can best be seen from FIG. 9, the horizontal cover plate 194 of the basin cover 122 is provided at the rear free edge thereof remote from the vertical retaining plate 196 with a projection 209 which engages in the gap between the end sections 150 of the two seating elements 140.

As can best be seen from FIGS. 1 to 4 and 10, the cutting board box 124 is arranged on the basin cover 122 and is in the form of a substantially cuboid folding box made from cardboard material.

The width of the cutting board box 124, i.e. the extent thereof in the transverse direction 148, corresponds to the distance between the inner surfaces of the central sections 146 of the seating elements 140 so that the cutting board box 124 is safeguarded from slippage in the transverse direction 148 by the seating elements 140.

The front surface 210 of the cutting board box 124 facing the vertical retaining plate 196 rests on the stop blocks 202 of the seating elements 140 so that the displacement path of the cutting board box 124 in the direction of the vertical retaining plate 196 is limited by the stop blocks 202.

The cutting board box 124 extends in the longitudinal direction 144 of the seating elements 140 up to a point 212 (see FIG. 9) at which the corner area of the seating elements 140 begins and the mutual clearance between the two oppositely located seating elements 140 begins to reduce so that the displacement path of the cutting board box 124 is also limited in the direction away from the vertical retaining plate 196.

The cutting board box 124 is thus accommodated between the stop blocks 202 and the corner areas of the seating elements 140 in a substantially play-free manner.

Figure 23:
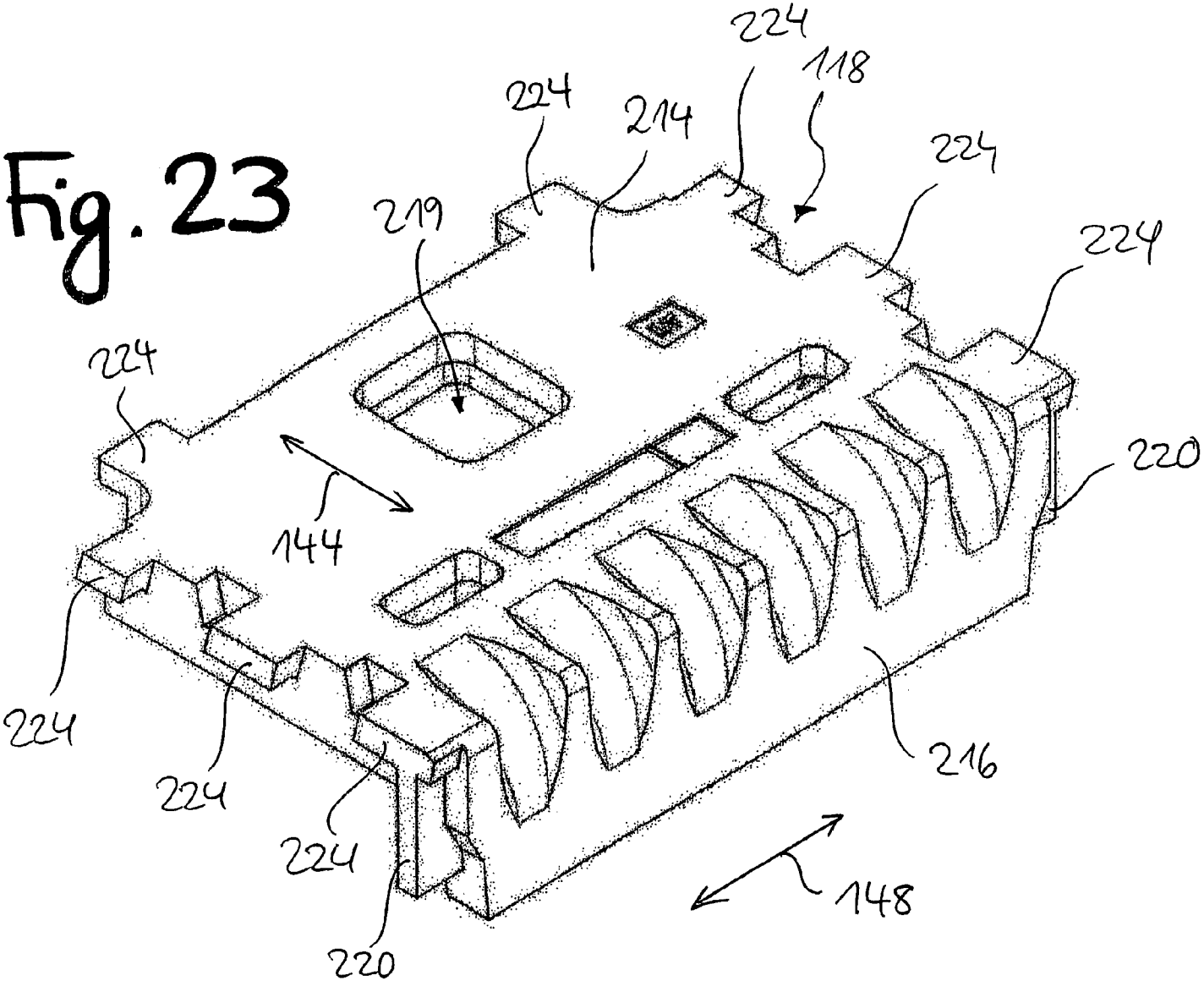
FIG. 23 a schematic perspective illustration of the intermediate element of the sink packaging as seen from above.
Figure 24:
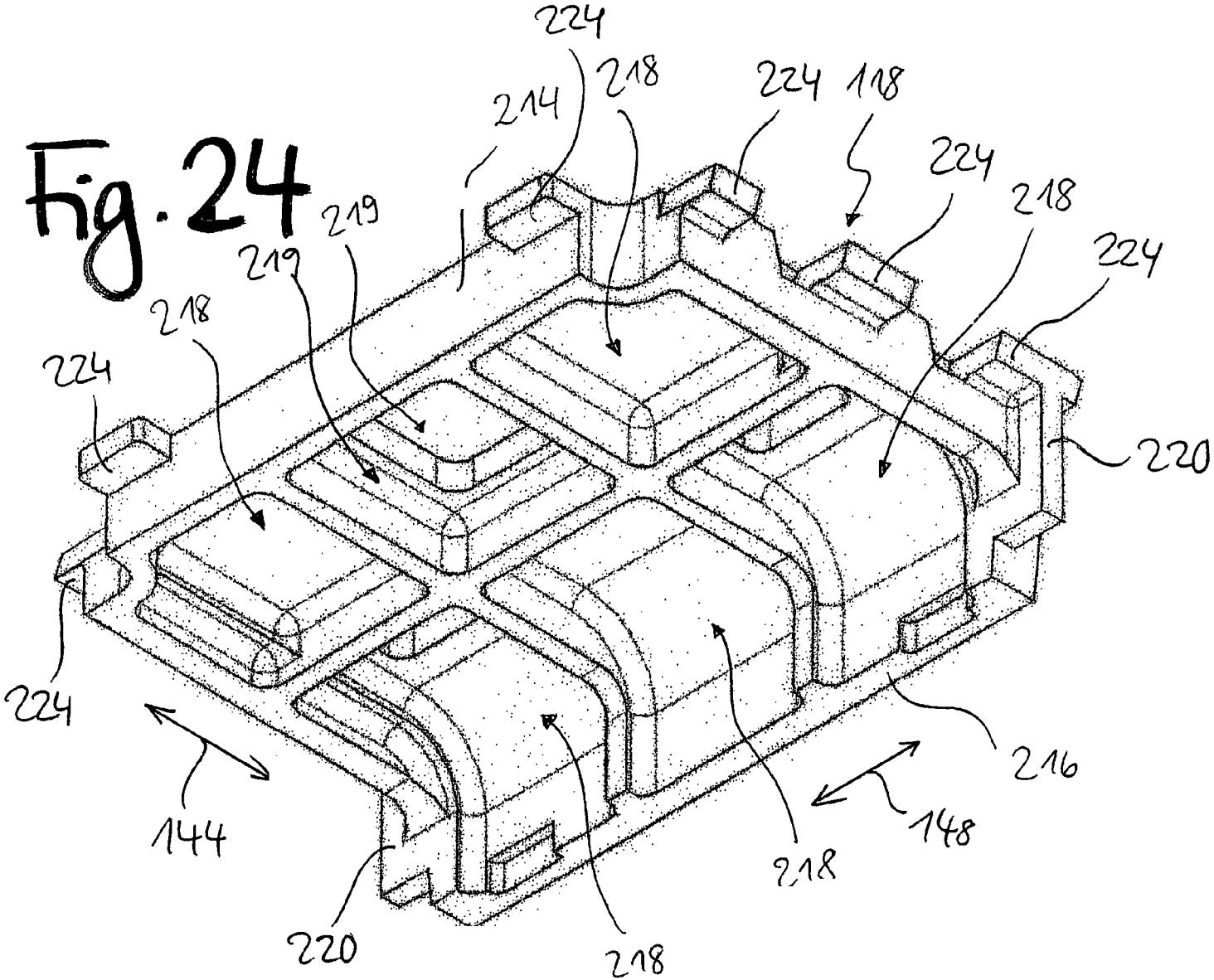
FIG. 24 a schematic perspective illustration of the intermediate element of the sink packaging as seen from below.

Furthermore, the sink packaging 100 comprises the angular intermediate element 118 which is separately illustrated in FIGS. 23 and 24 and which comprises a longer horizontal leg 214 and a shorter vertical leg 216.

The intermediate element 118 is in one-piece form and is preferably produced as a moulded article made from a foamable plastic material, in particular, from an expanded polystyrene material.

Preferably, the material of the auxiliary element 118 substantially ties in with the material of the seating elements 140 and the distance maintaining elements 142 of the sink packaging 100.

As can best be seen from FIG. 24, the lower surface of the horizontal leg 214 and the front surface of the vertical leg 216 of the intermediate element 118 that is remote from the sink 120 are provided with a plurality of recesses 218 and a break-through 219 which result in weight savings and entail an improvement in the shock-damping properties of the intermediate element 118.

The vertical leg 216 of the intermediate element 118 is provided at the lateral edges thereof with a respective vertically extending projection 220.

Each of the seating elements 140 and hence too, each of the distance maintaining elements 142 is provided with a vertical seating groove 222 corresponding to this projection, said groove being provided on the inner surface of the central section 146 of the relevant seating element 140 or distance maintaining element 142 facing the sink 120 (FIG. 19).

When the sink packaging 100 is in its assembled state, the vertical projections 220 of the vertical leg 216 of the intermediate element 118 engage in these vertical seating grooves 222 of the distance maintaining elements 142 so that the intermediate element 118 is safeguarded from movement relative to the distance maintaining elements 142 in the longitudinal direction 144 thereof due to the cooperation between the vertical projections 220 and the seating grooves 222.

Furthermore, the horizontal leg 214 of the intermediate element 118 is provided on the long sides thereof and on the end face thereof remote from the vertical leg 216 with a plurality of horizontal projections 224 which, in the assembled state of the sink packaging 100, engage in gaps formed between the seating element 140 and the distance maintaining element 142 of a supporting body 116 and cooperate with the projections 184 on the upper surface 182 of the distance maintaining elements 124 and with the projections 188 on the lower surface 186 of the seating elements 140 in such a way that the intermediate element 118 is safeguarded from movement relative to the two supporting bodies 116 in the longitudinal direction 144, in the transverse direction 148 and in the vertical direction.

As can be perceived from FIGS. 2 and 5, the intermediate element 118 separates the region of the sink packaging 100 within which the sink 120 is accommodated, from another sub-region of the sink packaging 100 in which the substantially cuboid mixer tap box 126 is accommodated. The intermediate element 118, which is fixed relative to the supporting bodies 116 of the sink packaging 100, thus prevents the mixer tap box 126, in which relatively heavy accessories, namely the mixer tap assembly for the sink 120 together with the pipework and installation material are contained, from slipping in the sink packaging 100 in such a way that it comes into contact with the sink 120 and thereby damages it.

The packaging of the sink 120 by means of the previously described sink packaging 100 can be effected in accordance with the procedure described hereinafter:

The distance maintaining elements 142 are connected together by means of the intermediate element 118 by inserting the vertical projections 220 of the vertical leg 216 of the intermediate element 118 into the vertical seating grooves 222 of the distance maintaining elements 142.

The mixer tap box 126 is inserted into the interior of the outer packaging 102 and placed on the base 106 thereof.

Subsequently, the arrangement consisting of the distance maintaining elements 142 and the intermediate element 118 is inserted into the interior of the outer packaging 102 in such a way that the distance maintaining elements 142 are seated on the base 106 of the outer packaging 102 with the longitudinal directions 144 thereof aligned in parallel with the long side walls 108 of the outer packaging 102 and the mixer tap box 126 is fixed in the desired packing position within the outer packaging 102 by the intermediate element 118.

Subsequently, the seating elements 140 of the supporting body 116 are pushed laterally onto the edge sections 136, 138 of the sink edge 134 of the sink 120 so that the edge of the sink 134 engages in the seating channels 152 of the seating elements 140.

After the seating elements 140 have been placed in position, the basin cover 122 is arranged on the upper surface of the sink 120 in that firstly, the rear free edge of the horizontal cover plate 194 of the basin cover 122 is pushed under the projections 208 on the end sections 150 of the seating elements 140, whereby the basin cover 122 is inclined to the horizontal in such a manner that that the vertical retaining plate 196 is located above the seating elements 140, and afterwards, the basin cover 122 is pivoted downwardly about the rear free edge of the horizontal cover plate 194 in such a way that the vertical retaining plate 196 of the basin cover 122 engages in the seating grooves 204 of the seating elements 140 corresponding thereto until the basin cover 122 rests upon the upper surface of the sink 120 and covers both the main basin 128 and the auxiliary basin 130.

If any accessories are to be accommodated in the main basin 128 or in the auxiliary basin 130 of the sink 120, then these accessories are inserted into the respective basin before putting on the basin cover 122.

After pushing the seating elements 140 onto the edge of the sink 134, the arrangement consisting of the sink 120, the seating elements 140 and the basin cover 122 is inserted vertically from above into the interior 114 of the outer packaging 102 so that the lower surfaces 186 of the seating elements 140 are seated on the upper surfaces 182 of the distance maintaining elements 142.

Subsequently, the cutting board box 124 is placed on the basin cover 122 in such a way that it rests on the stop blocks 202 of the seating elements 140.

Finally, the folding flaps 112 of the outer packaging 102 are folded in order to form a closed top wall for the outer packaging 102 which is then durably sealed by means of adhesive strips or strappings of a tape-like material for example, and is thereby made ready for transportation.

Figure 25:
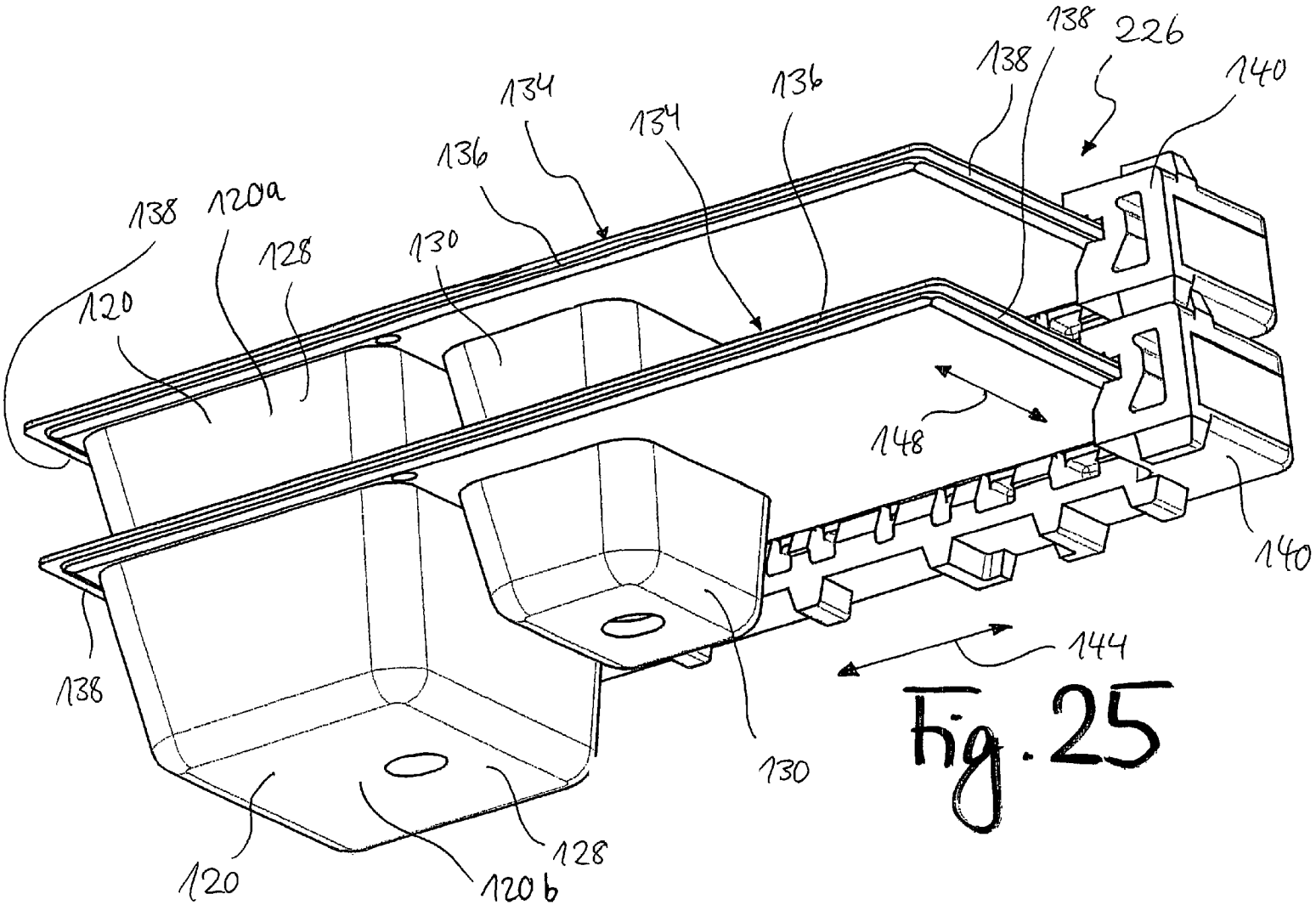
FIG. 25 a schematic perspective illustration of two seating elements of the sink packaging incorporating two sinks which are stacked directly upon one another, the edge sections of each of said sinks being accommodated in a respective seating channel of one of the seating elements.

Since the seating elements 140 of the supporting bodies 116 of the previously described sink packaging 100 are directly stackable upon one another, the same seating elements 140 can also be used for the production of a pile 224 of sinks 120 rather than just for the single packaging of an individual sink 120 in one outer packaging 102, as is illustrated in FIG. 25.

For the production of the pile 224 of sinks 120, two seating elements 140, which are formed in exactly the same way as the previously described seating elements 140, are pushed in each case onto mutually opposite edge sections of the sink edge 134 of the respective sink 120 so that the edge sections 136, 138 of the sink edge 134 engage in the seating channels 152 of the seating elements 140.

In order to fix the seating elements 140 on the respectively associated sink 120, provision may be made for the seating elements 140 to be attached to the sink 120 by means of adhesive strips and/or by means of a strapping of a tape-like material for example.

Subsequently, a plurality of the sinks 120 together with the seating elements 140 arranged thereon are stacked upon one another, in that the seating elements 140 connected to a sink 120*a* are lowered vertically in each case from above onto the seating elements 140 of a sink 120*b* arranged below it until the lower surface 186 of the seating elements 140 of the upper sink 120*a* rest upon the upper surface 182 of the seating elements 140 of the lower sink 120*b*, as is illustrated in FIG. 25.

The main basin 128 and the auxiliary basin 130 of the upper sink 120*a* thereby dip into the respective main basin 128 and the auxiliary basin 130 of the lower sink 120*b* so that the stacking height per sink, i.e. the vertical distance between the edges of the sinks 134 in the pile 224, is smaller than the height of a sink 120.

It is in this way that the sinks 120 can be arranged in a particularly space saving manner in the form of the pile 224 and can be stored in this arrangement, for example, before individual transportation in an outer packaging 102.

Since the same seating elements 140 are used for the production of the pile 224 as are also used as components of the sink packaging 100, the sinks 120 stored in the pile 224 can be packaged individually in a respective outer packaging 102 without previously removing the seating elements 140 and thus in a particularly time-saving manner, and in addition, the number of packaging elements needed for the purposes of storing the sinks in the pile 224 and for the subsequent individual packaging of the sinks 120 in a respective sink packaging 100 is reduced.

What is claimed is:

1. Packaging for a sink, comprising at least one supporting body which comprises at least one seating element incorporating a seating channel for an edge section of the sink and at least one distance maintaining element which is formed separately from the seating element and supports the seating element, wherein the seating element and/or the distance maintaining element are formed at least partly from a foamed plastic material.

2. Packaging in accordance with claim 1, wherein the seating channel of the seating element is formed for accommodating an edge section of a long side of the sink.

3. Packaging in accordance with claim 1, wherein the seating channel of the seating element is formed for accommodating an edge section of the sink which extends over the entire length of a side of the sink.

4. Packaging in accordance with claim 1, wherein the seating channel of the seating element is formed for accommodating an edge section of the sink which extends along a first side of the sink, and for accommodating an edge section of the sink which extends along a second side of the sink.

5. Packaging in accordance with claim 4, wherein the seating channel of the seating element is formed for accommodating an edge section of the sink which extends along a third side of the sink.

6. Packaging in accordance with claim 1, wherein the seating channel of the seating element is formed for accommodating at least one corner area of the edge of the sink.

7. Packaging in accordance with claim 1, wherein the distance maintaining element of the supporting body has the same shape as the seating element of the supporting body.

8. Packaging in accordance with claim 1, wherein the packaging comprises at least two supporting bodies which each comprise at least one seating element incorporating a seating channel for an edge section of the sink and at least one distance maintaining element which is formed separately from the seating element and supports the respectively associated seating element.

9. Packaging in accordance with claim 8, wherein the seating elements and the distance maintaining elements of the at least two supporting bodies are of the same shape.

10. Packaging in accordance with claim 8, wherein the at least two supporting bodies of the packaging are arranged on mutually opposite edge sections of the sink.

11. Packaging in accordance with claim 8, wherein the entire weight of the sink is borne exclusively by the supporting bodies which each comprise a seating element incorporating a seating channel for an edge section of the sink.

12. Packaging in accordance with claim 1, wherein the packaging comprises an outer packaging whose interior accommodates the sink and the at least one supporting body.

13. Packaging in accordance with claim 12, wherein the outer packaging is substantially cuboid.

14. Packaging in accordance with claim 12, wherein the outer packaging comprises a folding carton.

15. Packaging in accordance with claim 12, wherein the at least one supporting body extends over substantially the entire internal height (H) of the interior of the outer packaging.

16. Packaging in accordance with claim 1, wherein the seating element is in the form of a seating strip.

17. Packaging in accordance with claim 1, wherein the seating element is substantially L-shaped.

18. Packaging in accordance with claim 1, wherein the seating element is substantially U-shaped.

19. Packaging in accordance with claim 1, wherein the seating element comprises a longitudinal section which extends in the longitudinal direction of the sink.

20. Packaging in accordance with claim 1, wherein the seating element comprises at least one transverse section which extends in the transverse direction of the sink.

21. Packaging in accordance with claim 20, wherein the transverse section ends at a distance from the longitudinal central plane of the sink.

22. Packaging in accordance with claim 1, wherein the seating channel of the seating element is limited upwardly and/or downwardly by a plurality of channel delimiting projections which are spaced from one another in the longitudinal direction of the seating channel so that the sink comes into contact with the seating element only at the channel delimiting projections, but not in the regions located between the channel delimiting projections.

23. Packaging in accordance with claim 1, wherein the seating element comprises at least one end section which is provided with at least one cavity.

24. Packaging in accordance with claim 23, wherein the cavity has a vertical cross section which comprises a constriction.

25. Packaging in accordance with claim 23, wherein the cavity widens towards an end face of the end section.

26. Packaging in accordance with claim 23, wherein the end section provided with the cavity is provided with a recess at the side thereof facing the sink.

27. Packaging in accordance with claim 1, wherein the lower surface of the seating element is provided with projections and/or with recesses, wherein the upper surface of the distance maintaining element is provided with projections and/or with recesses, and wherein the projections and/or the recesses on the lower surface of the seating element cooperate with the projections and/or the recesses on the upper surface of the distance maintaining element in such a way that the seating element seated on the distance maintaining element is fixed relative to the distance maintaining element in the longitudinal direction thereof and/or in a horizontal transverse direction thereof extending transversely to said longitudinal direction.

28. Packaging in accordance with claim 27, wherein the packaging comprises a cover element which covers at least a part of the sink in the upward direction.

29. Packaging in accordance with claim 28, wherein the cover element covers at least one basin of the sink in the upward direction.

30. Packaging in accordance with claim 28, wherein the cover element does not extend over the entire upper surface of the sink.

31. Packaging in accordance with claim 28, wherein the cover element is in engagement with the seating element in such a way that it is safeguarded from movement relative to the seating element in the longitudinal direction thereof.

32. Packaging in accordance with claim 28, wherein the cover element is in engagement with the seating element in such a way that the displacement path thereof relative to the seating element is limited in the vertical direction.

33. Packaging in accordance with claim 28, wherein the cover element comprises a substantially horizontal cover section and a retaining section aligned transversely relative to the cover section.

34. Packaging in accordance with claim 1, wherein the packaging further comprises at least one accessory box, and wherein the seating element comprises at least one stop member which limits the displacement path of the accessory box relative to the seating element in the longitudinal direction of the seating element.

35. Packaging in accordance with claim 1, wherein the packaging comprises an accessory box and also two supporting bodies which each comprise a seating element, wherein the horizontal distance of the seating elements from one another corresponds substantially to the width of the accessory box.

36. Packaging in accordance with claim 1, wherein the packaging comprises at least two supporting bodies which each comprise a seating element and it also comprises an intermediate element which is arranged between the two supporting bodies.

37. Packaging in accordance with claim 36, wherein the intermediate element is in engagement with the supporting bodies in such a way that it is safeguarded from movement relative to the supporting bodies in the longitudinal direction thereof.

38. Packaging in accordance with claim 36, wherein the intermediate element is in engagement with the supporting bodies in such a way that it is safeguarded from vertical movement relative to the supporting bodies.

39. Packaging in accordance with claim 36, wherein the intermediate element comprises at least one projection which engages in a gap between the seating element and the distance maintaining element of one of the supporting bodies.

40. Packaging in accordance with claim 36, wherein the intermediate element comprises a substantially horizontal first section and a second section which is aligned transversely, preferably substantially perpendicularly, relative to the horizontal first section.

41. Packaging in accordance with claim 36, wherein the packaging comprises an accessory unit which is arranged below the sink, and wherein the intermediate element is so formed and arranged that it separates the accessory unit from the sink.

42. Packaging in accordance with claim 36, wherein the intermediate element is provided with at least one recess on the side thereof remote from the sink.

43. Packaging in accordance with claim 36, wherein the intermediate element is formed from substantially the same material as the seating elements of the supporting bodies.

44. Packaging in accordance with claim 1, wherein the seating element and/or the distance maintaining element are formed at least partly from an expanded polystyrene material.

45. Packaging in accordance with claim 1, wherein the seating element is substantially symmetrical relative to the vertical transverse central plane thereof.

46. Packaging in accordance with claim 1, wherein the seating element is stackable directly on another seating element of the same shape and orientation.

47. Packaging in accordance with claim 46, wherein the seating element, in whose seating channel an edge section of a sink is accommodated, is directly stackable on another seating element of the same shape and orientation in whose seating channel an edge section of a sink of the same shape and orientation is likewise accommodated.

48. Packaging in accordance with claim 46, wherein the lower surface of the seating element is provided with projections and/or with recesses, wherein the upper surface of the other seating element is provided with projections and/or with recesses, and wherein the projections and/or the recesses on the lower surface of the seating element cooperate with the projections and/or the recesses on the upper surface of the other seating element in such a way that the seating element seated on the other seating element is fixed relative to the other seating element in the longitudinal direction thereof and/or in a horizontal transverse direction (148) thereof extending transversely to said longitudinal direction.

* * * * *